US007102068B2

(12) United States Patent
Kitayama

(10) Patent No.: US 7,102,068 B2
(45) Date of Patent: Sep. 5, 2006

(54) WAVEFORM DATA ANALYSIS METHOD AND APPARATUS SUITABLE FOR WAVEFORM EXPANSION/COMPRESSION CONTROL

(75) Inventor: Toru Kitayama, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 11/016,294

(22) Filed: Dec. 17, 2004

(65) Prior Publication Data

US 2005/0098024 A1 May 12, 2005

Related U.S. Application Data

(62) Division of application No. 10/051,973, filed on Jan. 16, 2002.

(30) Foreign Application Priority Data

Jan. 17, 2001 (JP) ..... 2001-008813
Jan. 17, 2001 (JP) ..... 2001-008814
Jan. 17, 2001 (JP) ..... 2001-008815

(51) Int. Cl.
*G10H 7/12* (2006.01)

(52) U.S. Cl. ..... 84/607; 84/606

(58) Field of Classification Search ..... 84/602–607, 84/627, 663

See application file for complete search history.

(56) References Cited

U.S. PATENT DOCUMENTS 4,641,564 A 2/1987 Okamoto
4,794,837 A 1/1989 Katoh
5,256,832 A 10/1993 Miyake
5,466,882 A * 11/1995 Lee ..... 84/603
5,614,687 A 3/1997 Yamada et al.
5,877,446 A * 3/1999 Monahan et al. ..... 84/603
5,973,255 A 10/1999 Tanji
6,111,182 A 8/2000 Takahashi
6,232,540 B1 5/2001 Kondo
6,281,424 B1 * 8/2001 Koike et al. ..... 84/636

FOREIGN PATENT DOCUMENTS

JP 5-6172 1/1993
JP 9062257 3/1997
JP HEI09-127940 5/1997
JP 19319366 12/1997
JP 10031490 2/1998
JP HEI-10-31490 2/1998
JP 11-305775 11/1999
JP 11352967 12/1999

(Continued)

*Primary Examiner*—Lincoln Donovan
*Assistant Examiner*—David S. Warren
(74) *Attorney, Agent, or Firm*—Morrison & Foerster LLP

(57) ABSTRACT

Filtering is performed on original waveform to remove components of a predetermined frequency band from the waveform, and dividing positions of the original waveform data are determined on the basis of envelope levels of the filtered waveform. The dividing positions may be determined on the basis of differentiation of an envelope of the filtered waveform. Rise positions in the original waveform data are detected, and one rise position may be selected from among one or more rise positions detected within a predetermined range of the original waveform and extracted as a dividing position of the original waveform. Presumed beat positions in the original waveform may be detected, and rise positions of the original waveform may be detected within predetermined ranges corresponding to the presumed beat positions. In parallel with reproduction of automatic performance, waveform data are stored in memory along with synchronization control data indicative of relationship in processing timing between the automatic performance and the waveform data.

9 Claims, 19 Drawing Sheets

FOREIGN PATENT DOCUMENTS

| | | |
|---|---|---|
| JP | 2000-137485 | 5/2000 |
| JP | 2000-163068 | 6/2000 |
| JP | 2000-181458 | 6/2000 |
| JP | P2000-172279 A | 6/2000 |
| JP | 2000-322061 | 11/2000 |

* cited by examiner

INPUT SIGNAL

RESULT OF UNNECESSARY FREQUENCY BAND REMOVAL

ABSOLUTE VALUE

RESULT OF ENVELOPE FOLLOWER PROCESS

RESULT OF LOW-PASS FILTER PROCESS

RESULT OF COMPRESSOR PROCESS

RESULT OF EDGE EXTRACTION

EDGE INFORMATION

DOWNBEAT DETECTING WINDOW

RESULT OF DOWNBEAT DETECTION

UPBEAT DETECTING WINDOW

RESULT OF DOWNBEAT & UPBEAT DETECTION

EDGE INFORMATION EXCLUDED FROM DETECTING WINDOW

| WAVEFORM-DATA-GENERATION-START TRIGGERING CLOCK COUNT | WAVEFORM DATA | RISING TIME Tt [ msec ] |
|---|---|---|
| 0 | 1t | 0 |
| 28 | 2t | 30 |
| 74 | 3t | 40 |
| : | : | : |
| 349 | 11t | 20 |
| 370 | 12t | 10 |

WAVEFORM DATA ANALYSIS METHOD AND APPARATUS SUITABLE FOR WAVEFORM EXPANSION/COMPRESSION CONTROL

This is a divisional application of U.S. patent application Ser. No. 10/051,973, filed on Jan. 16, 2002, which is specifically incorporated herein, in its entirety, by reference.

BACKGROUND OF THE INVENTION

The present invention relates to an improved waveform data analysis method and waveform data analysis apparatus suitable for automatic performances, particularly automatic accompaniments, executed by personal computers, electronic musical instruments, amusement equipment, etc. as well as a computer program to be used for the waveform data analysis.

Heretofore, there has been known the technique of recording tones of a natural musical instrument or the like of certain lengths and then automatically reproducing the thus-recorded tones repetitively at a rate corresponding to a set tempo. With this technique, often used in an automatic accompaniment of rhythm tones or the like, it is necessary to expand or compress the original waveforms in accordance with a set tempo, in order to avoid reproduction pitch variations. For example, to this end, original waveform data, obtained by stereophonic recording of tones of a natural musical instrument or the like are divided at rise portions (for convenience of description, hereinafter referred to as "waveform data control points") of an envelope and thereby divided into a plurality of sections (for convenience of description, hereinafter referred to as "original sections"). When an automatic rhythm accompaniment or the like is to be performed using such original waveform data, the original waveform data may be reproduced repetitively as they are without being subjected to particular processing, as long as the waveform data are reproduced at a same tempo as when they were recorded (i.e., as long as the reproducing tempo of the waveform data is the same as the original recording tempo).

When, however, the reproducing tempo is to be faster than the original recording tempo, it is necessary to shorten the individual original sections to be reproduced; for this purpose, respective end segments of the original sections may be cut off at a given ratio. For example, if the original recording tempo is "100" and the reproducing tempo is "125", the end segments of the individual original sections may each be cut off by 20% to allow only the remaining waveform data to be reproduced. On the other hand, when the reproducing tempo is to be slower than the original recording tempo, there arises a problem. Namely, if reproduction start timing of the individual original sections is simply delayed in accordance with the desired reproducing tempo, silent segments are produced in gaps between the successive original sections, which tend to become offensive to the ears. Thus, it has been conventional to add, to each of the gaps between the original sections, a necessary length of the waveform data of the immediately-preceding original section. At that time, the initial amplitude value of a portion of the waveform data to be added to fill in the gap is set to coincide with the amplitude value of a portion of the waveform data immediately preceding the to-be-added portion.

However, the above-mentioned conventional technique has not been satisfactory in that the waveform data control points, i.e. dividing positions for waveform control, can not be necessarily set at appropriate positions. Namely, although the conventional technique is arranged to set the waveform data control point at a position of the envelope where the amplitude exceeds a predetermined threshold value, no waveform data control point is sometimes set automatically even at a position that can be identified as a rise portion through the human auditory sense because the peak does not reach the threshold value. In such a case, a plurality of beats may be undesirably included in a single original section, and the tempo compression/expansion can not be executed properly between these beats. Conversely, at a position where there is a great envelope variation, a plurality of the waveform data control points are sometimes set at the position even though the position is identified as a single beat through the human auditory sense, so that unnatural compression/expansion tends to be executed.

Further, where the original recording tempo and reproducing tempo are different from each other and if the reproduction start timing of the individual sections is controlled simply in accordance with a ratio between the original recording tempo and the reproducing tempo, there would be undesirably produced a sense of "tardiness" or "heaviness" particularly in a waveform having slow rise portions. Specific example of the "tardiness" or "heaviness" will be later explained in relation to FIG. 3A, which may be referred to as necessary. In short, the problem of the "tardiness" "heaviness" is due to the fact that reproducing a waveform time-axially expanded to make the reproducing tempo slower than the standard tempo would make listeners to feel as if beats occurred at timing earlier than preferred timing while reproducing a waveform at a faster tempo than the recording tempo would make listeners to feel as if beats occurred at timing later than preferred timing.

Further, it has been known to use the following devices or software in order to compress or expand an original waveform in accordance with a set tempo.

(1) Sampler: The sampler samples an analog waveform and converts it into digital waveform data. There have been known two major types of samplers, one type for recording a single tone waveform and the other type for recording a phrase waveform made up of a plurality of tones; the other type is commonly known as a "phrase sampler".

(2) Slicer: The slicer allocates serial note numbers to divided waveform data starting with the leading waveform data, and generates and stores automatic performance information composed of the allocated note numbers and timing (dividing positions), i.e. generates and stores sequence data for driving the divided waveform data. Original waveform data (waveform data before the division) can be reproduced by executing an automatic performance on the basis of the automatic performance information at the original recording tempo while triggering the divided waveform data in response to reproduced note-on events. If the tempo is changed, the timing of the note-on events varies in accordance with the changed tempo so that the waveform data as a whole are expanded or compressed in a time-axial direction.

(3) Sequencer: The sequencer reproduces the above-mentioned sequence data. However, in addition to reproducing the sequence data merely as they are, the sequencer can reproduce the sequence data at any desired tempo by increasing or decreasing the reproducing speed as appropriate. Note that the reproduction timing of the individual unit waveform data can of course be independently varied as desired in advance by previously editing the sequence data.

As the sequence data are supplied to a suitable tone generator, tone waveforms are reproduced on the basis of the reproduced sequence data.

Let's now consider a case where a new track is added to given original sequence data and additional sequence data obtained by the above-mentioned technique are written into the new track so as to create ensemble (synthesized) sequence data. Because the original sequence data and additional sequence data are recorded independently of each other, merely writing the additional sequence data into the new track would result in undesired timing differences between the original sequence data and the additional sequence data. Thus, there is a need to deliberately adjust the timing of the original sequence data and additional sequence data to accurately coincide with each other, which is a very complex and troublesome task. Particularly, in a case where the tempo of the original sequence data is varied at a halfway position of the sequence data, for example, it is necessary to perform the timing adjustment here and there in a music piece in question. Further, because the conventional technique is arranged to divide the waveform data only on the basis of dividing positions obtained through analysis of an envelope of the waveform data, there is a possibility of the dividing positions being detected erroneously or the waveform data being divided at musically inappropriate positions.

SUMMARY OF THE INVENTION

In view of the foregoing, it is an object of the present invention to provide a waveform data analysis method and waveform data analysis apparatus which can determine optimal dividing positions (waveform data control points) of waveform data, as well as a computer program to be used for the waveform data analysis.

It is another object of the present invention to provide a waveform data analysis method and waveform data analysis apparatus which can record waveform data in association with automatic performance data, as well as a computer program to be used for such waveform data analysis.

According to one aspect of the present invention, there is provided a waveform data analysis method which comprises: a step of performing a filter process for removing components of a predetermined frequency band from original waveform data; and a step of determining dividing positions of the original waveform data on the basis of envelope levels of the waveform data having been subjected to the filter process. Such arrangements can appropriately remove components of a predetermined frequency band, such as sustainable components of vocal sounds, bass tones or the like in the original waveform data, that would impede detection of optimal dividing positions of the waveform data, and thereby permits appropriate envelope level analysis and hence determination of optimal dividing positions. As in the above-discussed conventionally-known technique, the thus-determined dividing positions may be used, for example, as waveform data control points when the original waveform data are to be compressed or expanded with a view to variably controlling a reproducing performance tempo without changing a pitch feeling of the original waveform data.

According to another aspect of the present invention, there is provided a waveform data analysis method which comprises: a step of performing a filter process for removing components of a predetermined frequency band from original waveform data; a step of detecting an envelope of the waveform data having been subjected to the filter process; and a step of determining dividing positions of the original waveform data on the basis of differentiation of the detected envelope. Such arrangements too permits determination of optimal dividing positions of the waveform data.

As one example, the waveform data analysis method may further comprise an amplitude conversion step of reducing an amplitude level difference in the detected envelope, and the step of determining dividing positions may determine the dividing positions of the original waveform data on the basis of differentiation of the envelope having been processed by the amplitude conversion step. As another example, the step of determining dividing positions may include a step of detecting peak levels corresponding to the determined dividing positions. In such a case, the method may further comprise a step of setting a time difference (Td) between a reproduction start time point of the original waveform data and a start time point of a given dividing position of the original waveform data as $$Td=n(Ts+Tt)-Tt$$

where Ts represents an original time difference between a reproduction start position of the original waveform data and a start position of the given dividing position, Tt represents an original time difference between the given dividing position and a peak position where a peak level corresponding to the given dividing position occurs, and n represents an expansion/compression ratio of a reproducing tempo at which the original waveform data are to be reproduced.

According to still another aspect of the present invention, there is provided a waveform data analysis method which comprises: a step of determining presumed beat positions in original waveform data; a step of detecting rise positions in the original waveform data within predetermined ranges corresponding to the determined presumed beat positions; and a step of extracting any one of the detected rise positions as a dividing position of the original waveform data. Such arrangements too permits determination of optimal dividing positions of the waveform data.

According to still another aspect of the present invention, there is provided a waveform data analysis method which comprises: a step of detecting rise positions in original waveform data; and a step of selecting one rise position from among one or more rise positions detected within a predetermined range of the original waveform data and extracting the selected rise position as a dividing position of the original waveform data. Such arrangements too permits determination of optimal dividing positions of the waveform data.

According to still another aspect of the present invention, there is provided a waveform data analysis method which comprises: a step of reproducing automatic performance information; a step of storing waveform data in parallel with reproduction of the automatic performance information; and a step of storing synchronization control data indicative of relationship in processing timing between the automatic performance information and the waveform data, in correspondence with storage of the waveform data. With such arrangements, the waveform data can be stored in association with the automatic performance information. Further, because the synchronization control data can be obtained in association with the automatic performance information, it is possible to properly and readily determine dividing positions of the waveform data that should function as waveform data control points.

According to still another aspect of the present invention, there is provided a waveform data processing method which comprises: a step of dividing original waveform data into a plurality of sections; and a step of adding waveform data of an additional section to an end of a selected one of the sections divided from the original waveform data by said step of dividing, the waveform data of the additional section attenuating, with passage of time, from an initial value equal to an envelope level at the end of the selected section.

According to still another aspect of the present invention, there is provided a waveform data processing method which comprises: a step of dividing original waveform data into a plurality of sections; a step of, in correspondence with the sections divided from the original waveform data by said step of dividing, previously generating and storing waveform data of additional sections to be added to individual ones of the divided sections; a step of, when a reproducing tempo is faster than a predetermined standard, using the original waveform data of the individual divided sections to reproduce a waveform without using the waveform data of the additional sections; and a step of, when the reproducing tempo is slower than the predetermined standard, reproducing a waveform by adding the waveform data of corresponding ones of the additional sections to the divided sections to follow the waveform data of the divided sections.

The present invention may be constructed and implemented not only as the method invention as discussed above but also as an apparatus invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the objects and other features of the present invention, its embodiments will be described in greater detail hereinbelow with reference to the accompanying drawings, in which.

DETAILED DESCRIPTION OF EMBODIMENTS

Figure 1:
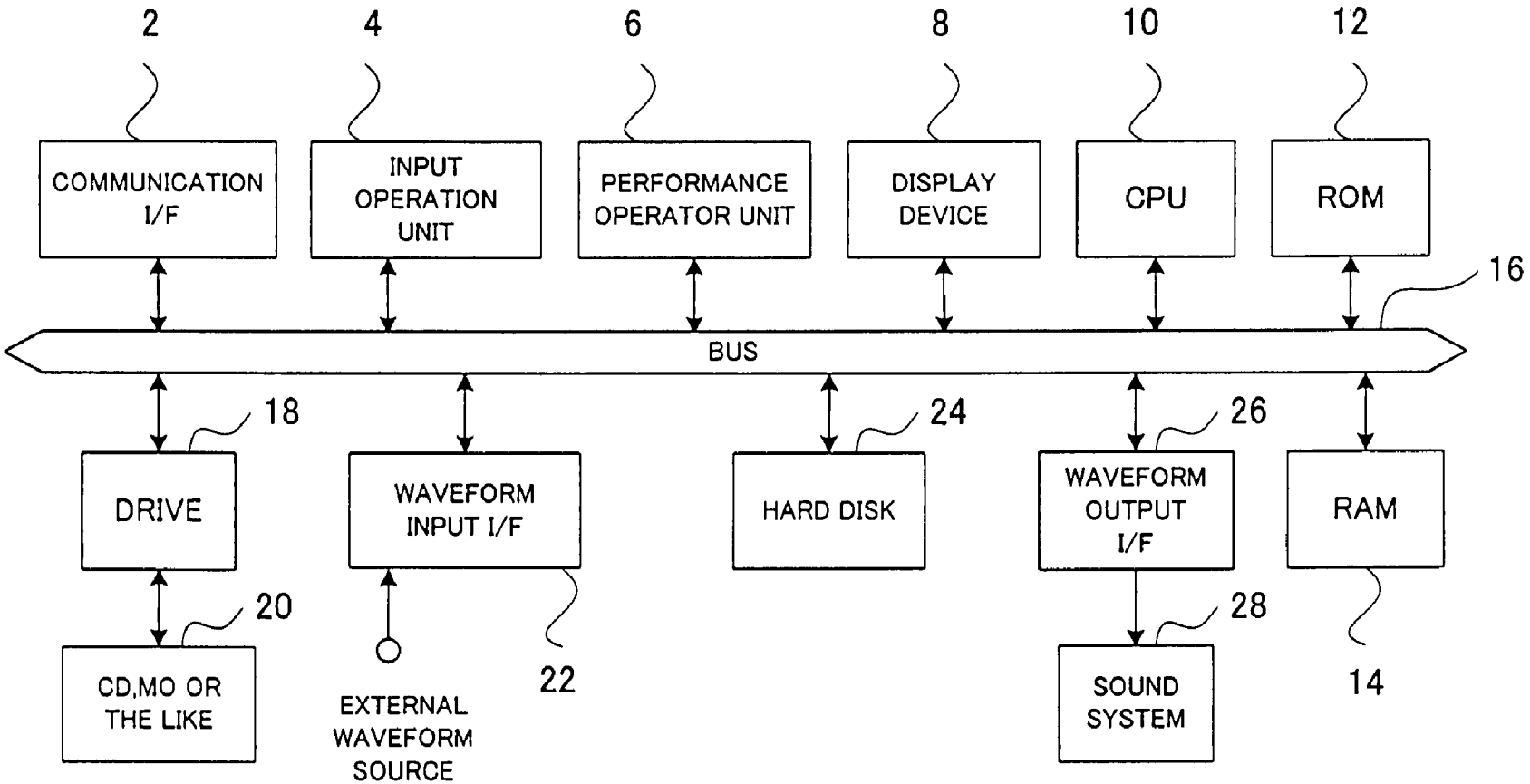
FIG. 1 is a block diagram showing an exemplary general hardware setup of a waveform editing system in accordance with a first embodiment of the present invention.

1. Hardware Setup of First Embodiment:

The following paragraphs describe an exemplary general hardware setup of a waveform editing system in accordance with a first embodiment of the present invention, with reference to FIG. 1. This waveform editing system comprises an application program and drivers run on a general-purpose computer and various other components.

The waveform editing system includes a communication interface (I/F) 2 that communicates waveform data and various other data via an external network such as the Internet, an input operation unit 4 including a keyboard and mouse, a performance operator unit 6 including pad operators for simulating a keyboard and percussion instrument and the like, and a display device 8 that visually displays various information to a user.

The waveform editing system also includes a CPU 10 that controls various other components in the waveform editing system via a bus 16 on the basis of later-described programs, a ROM 12 having stored therein an initial loader program and the like, and a RAM 14 on which various data are written and read via the CPU 10. Reference numeral 18 represents a drive device that writes and reads data to and from a storage medium 20 such as a CD-ROM or MO (Magneto-Optical) disk. The waveform editing system further includes a waveform input interface (I/F) 22 that samples an analog waveform input from an external waveform source, converts the input analog waveform into digital waveform data and outputs the digital waveform data via the bus 16. Reference numeral 24 represents a hard disk where are stored an operating system of the general-purpose computer, later-described waveform-editing application program, waveform data and the like. Reference numeral 26 represents a waveform output interface that converts digital waveform data, supplied via the bus 16, into an analog waveform so that the converted analog waveform is audibly reproduced or sounded via a sound system 28.

2. Behavior of First Embodiment:

The following paragraphs describe behavior of the first embodiment. Upon powering-on of the personal computer, the initial loader program stored in the ROM 12 is executed so that the operating system is started up. Once predetermined operation is performed by the user while the operating system is ON, the waveform-editing application program is triggered.

2.1. Acquisition of Original Waveform Data:

Once predetermined operation is performed by the user while the waveform-editing application program is ON, original waveform data to be processed are loaded into the RAM 14 or hard disk 24 via the waveform input interface 22. Note that the original waveform data to be processed may be acquired via the communication interface 2 or storage medium 20.

Figure 4:
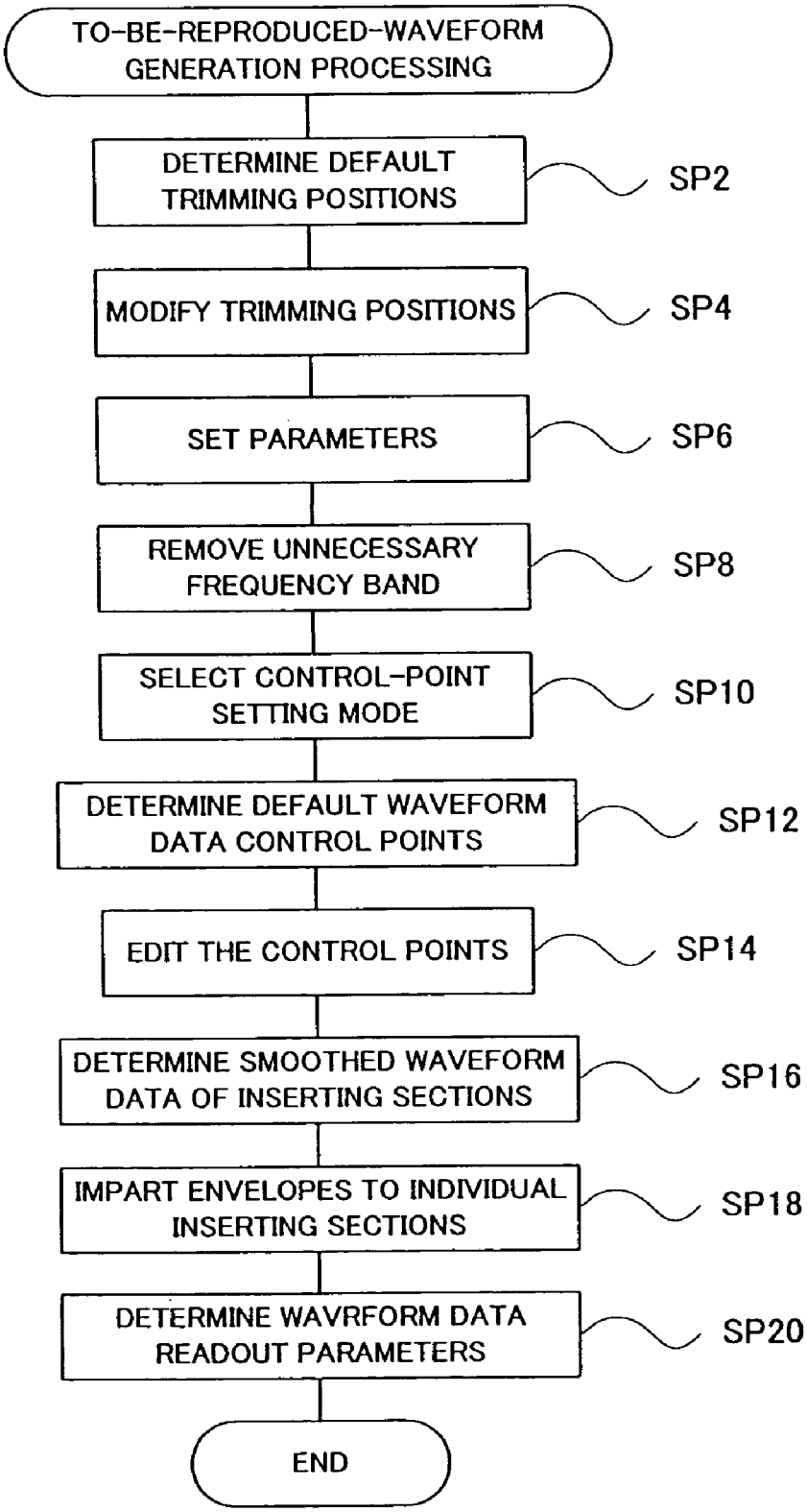
FIG. 4 is a flow chart of to-be-reproduced-waveform-data generation processing performed in the first embodiment.

2.2. To-be-Reproduced-Waveform-Data Generation Processing:

2.2.1. Trimming Process (steps SP2 and SP4 of FIG. 4):

Once predetermined operation is performed by the user after the acquisition of the original waveform data, a to-be-reproduced-waveform-data generation processing routine shown in FIG. 4 is invoked in the waveform editing application program. The original waveform data sometimes have silent segments at the start and end portions of the data, in which case such silent segments are automatically trimmed or removed at step SP2. Note that the silent segments are preferably trimmed in accordance with a performance tempo or the like of the recorded original waveform data in such a manner that the waveform data have a length corresponding to a predetermined multiple (natural number multiple) of a measure (bar) length. However, if the original waveform data include noise, then the silent segments can not always be trimmed at appropriate positions. Thus, in the instant embodiment, the user is allowed, at next step SP4, to modify, as desired, automatically-determined default trimming positions. It is preferable that the trimming positions be set at positions such that the performance tempo can be properly prevented from collapsing when the waveform data between the trimming positions are reproduced in a looped fashion (i.e., positions such that the waveform data have a total length corresponding to a given natural number multiple of the measure length.

2.2.2. Parameter Setting Process (step SP6):

After step SP4, the to-be-reproduced-waveform-data generation processing routine moves on to step SP6, where the user designates various parameters for detecting waveform data control points. Examples of the various parameters to be designated by the user include the following.

(1) Waveform Type: The waveform type parameter specifies, for example, a desired type of waveform, such as a percussion-type or sustainable-type waveform, and is classified into a plurality of variations suited to original waveform data of various musical instruments. Default values of thresholds and various other parameters are set on the basis of the waveform type.

(2) Number of Measure: This number-of-measure parameter specifies, by one of natural numbers raging, for example, from "1" to "8", a desired number of measures to be included in the waveform data after having been subjected to the silent segment trimming.

(3) Musical Time: This musical time parameter specifies musical time of the waveform data, e.g. one of 1/4 (one-four time)–8/4 (eight-four time), 1/8 (one-eight time) 16/8 (sixteen-eight time) and 1/16 (one-sixteen time)–16/16 (sixteen-sixteen time). Because the total time length of the waveform data is already known, one specific tempo can be uniquely set once only the number of measures and musical time have been set.

(4) Resolution: This resolution parameter specifies particular resolution with which each measure of the waveform data is to be examined in order to detect control points of downbeats and upbeats. For example, where the musical time is "4/4" (four-four time), any one of resolution values "1/4", "1/4(+3)", "1/8", "1/8(+3)", "1/16", "1/16(+3)" and "1/32" can be designated; here, "(+3)" means division into triplets. In this case, designation of the "1/4" resolution causes the waveform data to be examined every quarter (1/4) timing of each measure (i.e., at points dividing each measure into four equal portions, or at each quarter note timing), designation of the "1/4(+3)" resolution causes the waveform data to be examined every 1/12 timing of each measure, designation of the "1/8" resolution causes the waveform data to be examined every 1/8 timing of each measure (i.e., points dividing each measure into eight equal portions, or at each eighth-note timing), designation of the "1/8(+3)" resolution causes the waveform data to be examined every 1/24 timing of each measure, designation of the "1/16" resolution causes the waveform data to be examined every 1/16 timing of each measure (i.e., at each sixteenth-note timing), designation of the "1/16(+3)" resolution causes the waveform data to be examined every 1/48 timing of each measure, and designation of the "1/32" resolution causes the waveform data to be examined every 1/32 timing of each measure.

Figure 19:
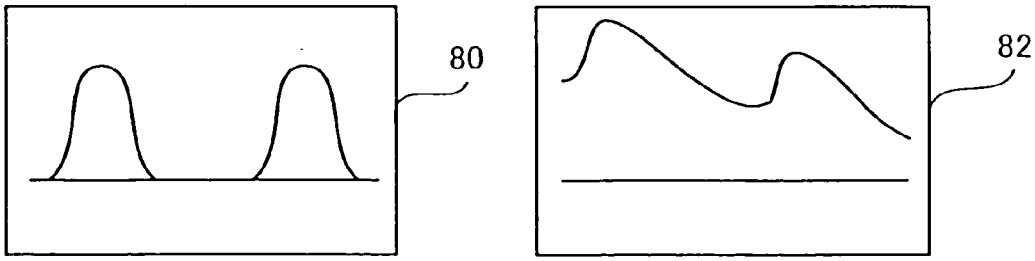
FIG. 19 is a diagram showing a percussion-type waveform selection button and a sustainable-type waveform selection button employed in the first embodiment.

Of the above-mentioned various parameters, the waveform type can be selected in the following manner. Namely, a percussion-type waveform selection button 80 and sustainable-type waveform selection button 82 are displayed on the display device 8 as illustrated in FIG. 19, and one of the displayed two waveform types can be selected by the user mouse-clicking the corresponding button 80 or 82 on the display device 8. The percussion-type waveform can be suitably used not only for mere percussion-type waveform data but also other intermittent-type waveform data. As shown in FIG. 19, an intermittent waveform is displayed in association with the percussion-type waveform selection button 80 while a continuous waveform is displayed in association with the sustainable-type waveform selection button 82, so that the user can recognize and select a desired waveform type at a glance.

2.2.3 Unnecessary-band Removing Filter Process (step SP8):

The waveform data, having been subjected to the silent segment trimming, contain various frequency components, which include components of an unnecessary frequency band that become an obstacle to the detection of the waveform data control points. Therefore, at next step SP8, a filter process is carried out for removing components of such an unnecessary frequency band from the waveform data. Contents of the filter process are generally classified into two major types: a band cut filter process; and a high-pass filter process, and it is preferable that the contents of the filter process be determined in accordance with the designated waveform type. That is, either one or both of the band cut filter process and high-pass filter process is carried out, and parameters for use in the filter process are also determined in accordance with the designated waveform type.

The following paragraphs describe an exemplary manner in which the parameters for use in the filter process are set. Of the waveform data, components having pitches, such as those of melody data, have a high possibility of becoming an obstacle in the waveform data control point detection. Analysis of a variety of music pieces has revealed that many of such components, i.e. components of a sustainable portion of vocal sounds, bass tones or the like, appear in a "80 Hz–8 kHz" frequency band and particularly in a "100 Hz–300 Hz" frequency band. For this reason, the band cut filter process is performed in such a manner as to attenuate the "80 Hz–8 kHz" frequency band and particularly in the "100 Hz–300 Hz" frequency band. Note that because components of an attack portion (consonant, attack noise and the like) of vocal sounds, bass tones or the like spread widely across other frequency bands than the "80 Hz–8 kHz" frequency band, the waveform data control points can be detected even when the filter process has been performed.

Figure 5A:
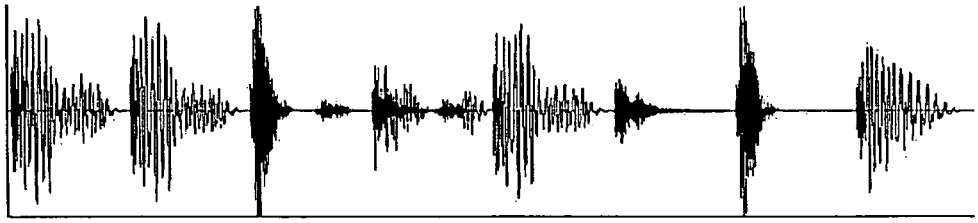
FIGS. 5A and 5B are diagram showing waveforms before and after an unnecessary frequency band removal process performed in the first embodiment.
Figure 5B:
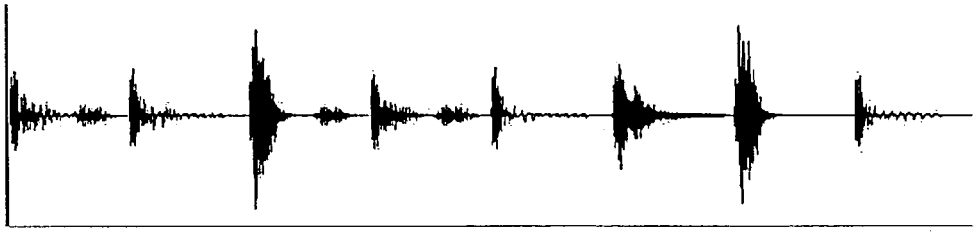
Figure 15:
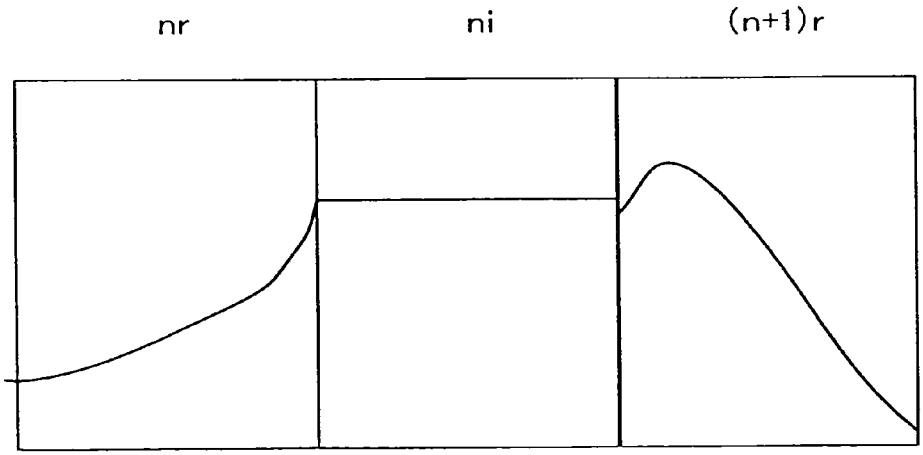
FIG. 15 is a diagram explanatory of a process performed in the first embodiment for setting envelope levels in the inserting section.

In a band performance or the like, high-frequency tones of a cymbal or the like are performed and recorded regularly. In such a case, it is more advantageous to carry out the high-pass filter process for extracting only the regular high-frequency components. Because neither of the band cut process and high-pass filter process requires steep filter characteristics, it is, in practice, only necessary that a first-order filter be used in the high-pass filter process and a second-order filter be used in the band cut filter process. As an exemplary result of the unnecessary-band removing filter process, a waveform after having been subjected to the silent segment trimming are shown in FIG. 5A, and a waveform after having been subjected to the filter process is shown in FIG. 5B; note that in this case, the number of measures of the waveform data is "two", the musical time is "4/4", and the resolution is "1/8".

Figure 2A:
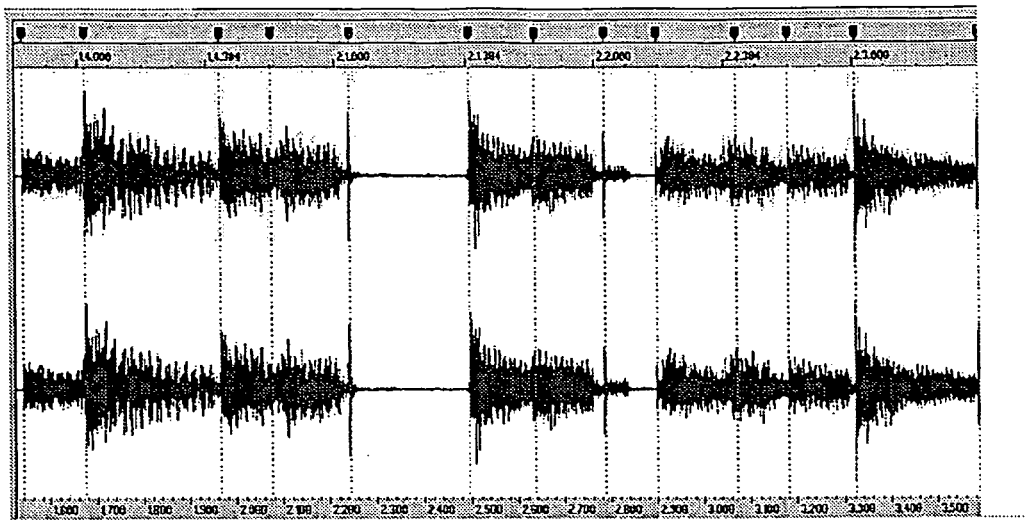
FIGS. 2A–2C are diagrams explanatory of processing for generating inserting sections and coupled sections in the first embodiment.
Figure 2B:
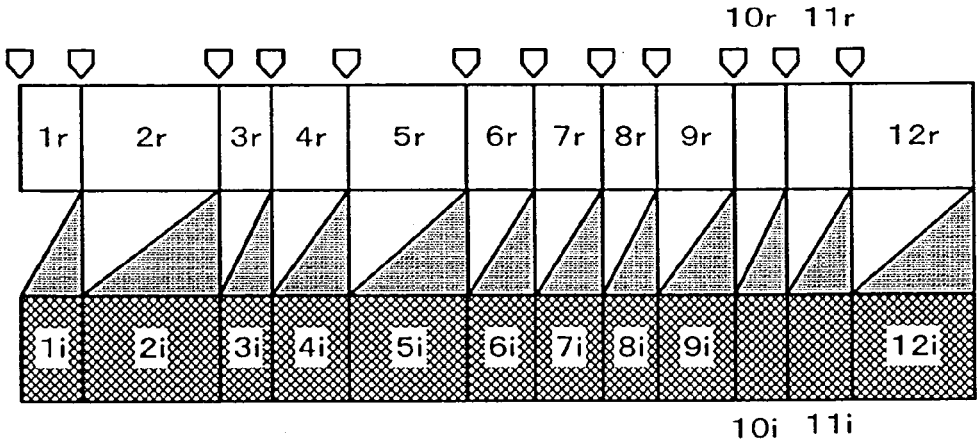

2.2.4. Determination of Default Waveform Data Control Point (steps SP10 and SP12):

As noted earlier, the waveform data control points are reference positions to be used for editing waveform data. First, an exemplary manner in which waveform data control points are set will be described with reference to FIGS. 2A and 2B. Specifically, FIG. 2A shows original waveform data obtained by stereophonically recording tones of a natural musical instrument or the like. The original waveform data are divided or segmented at rise start positions (positions denoted by dotted lines in the figure and these positions are called "waveform data control points") of a tone volume envelope, so that original waveform data can be divided into a plurality of sections called "original sections" 1*r*–12*r* as shown in FIG. 2B.

Referring back to FIG. 4, the user, at step SP10, designates either a simple determination mode or an analysis mode as an operation mode or scheme for setting default waveform data control points. At next step SP12, default waveform data control points are automatically determined in accordance with the user-designated operation mode. Namely, in the "simple determination mode", the waveform data control points are set on a beat-by-beat basis; for example, where the number of measures is "1" and the musical time is "4/4", the waveform data control point is set at every 1/4 position of the waveform data in the measure (every point dividing the measure into four equal portions), and where the number of measures is "2" and the musical time is "4/4", the waveform data control point is set at every 1/8 position of the waveform data in the measures (every point dividing the measures into eight equal portions).

In the "analysis mode", the waveform data control points are determined on the basis of analyzed results of the waveform data. Specifically, rise start positions, peak positions, etc. of a tone volume envelope are detected, and the waveform data control points are set on the basis of the detected results. The default waveform data control points having been determined in the above-mentioned manner are displayed on the display device 8 along with the waveform data, as illustratively shown in FIG. 2A. In the illustrated example of FIG. 2A, the waveform data, which are stereophonically recorded data, are shown as comprising left-channel and right-channel waveform data—in the figure, the upper waveform represents the left-channel waveform data while the lower waveform represents the right-channel waveform data—. The waveform data control points are each denoted in the figure by vertical dotted lines and apply to both of the two channels. By thus setting the common control points for more than one channel, time positions can be readily synchronized between the channels even when the time axis has been controlled. Information indicative of the thus-set waveform data control points is stored in memory as necessary. The following paragraphs describe details of the process for determining the default waveform data control points in the analysis mode, with reference to FIG. 6.

Figure 6:
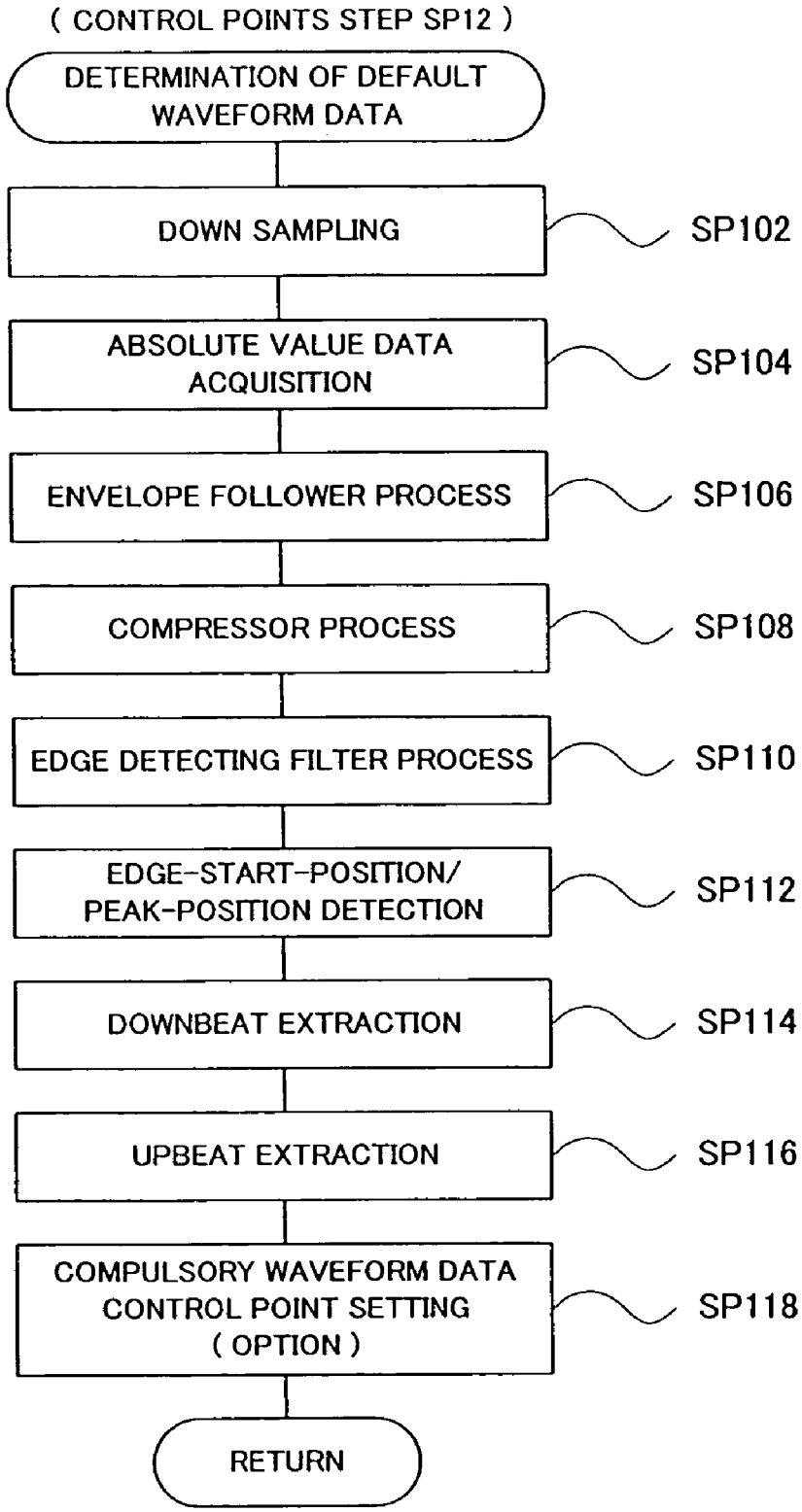
FIG. 6 is a flow chart of a process for determining default waveform data control points in an analysis mode of the first embodiment.

(1) Down-Sampling Process (step SP102):

At step SP102 of FIG. 6, a down-sampling process is performed on the waveform data having the components of the unnecessary frequency band removed therefrom. This is because the sampling frequency necessary for determining the waveform data control points is far lower than the sampling frequency of the audio data to be listened to by human listeners and thus, in order to execute subsequent processes at higher speeds, it is more preferable to lower the sampling frequency of the audio data to thereby provide down-sampled waveform data.

Figure 7A:
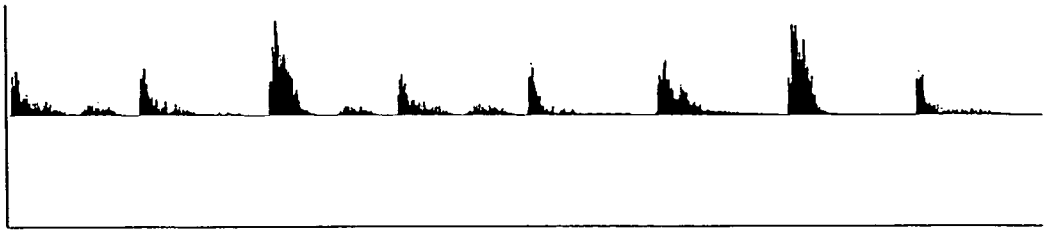
FIGS. 7A–7D are diagrams showing waveforms output from an absolute value acquisition process performed in the first embodiment.

(2) Absolute Value Acquisition Process (step SP104):

Respective absolute values of the down-sampled waveform data are obtained at step SP104. In FIG. 7A, there are shown exemplary absolute values obtained in relation to the waveform of FIG. 5B.

Figure 8:
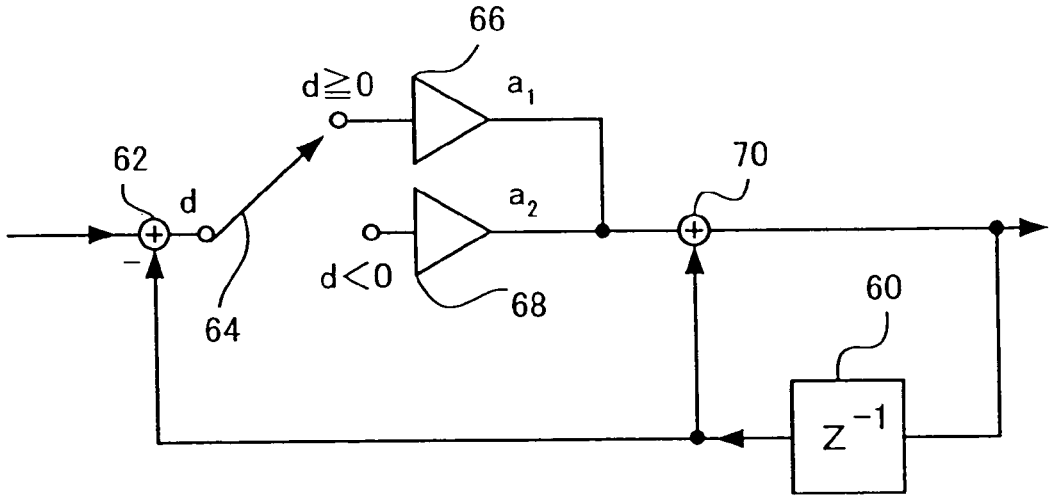
FIG. 8 is a block diagram showing an example of circuitry equivalent to an algorithm of an envelope follower process performed in the first embodiment.

(3) Envelope Follower Process (SP106):

At next step SP106 of FIG. 6, an envelope follower process is performed, on the absolute values of the waveform data (absolute value waveform) shown in FIG. 7A, to obtain an envelope waveshape of the absolute value waveform). The envelope follower process is characterized by causing the envelope waveshape to rise steeply relative to the rising phase of the absolute value waveform and to fall slowly relative to the falling phase of the absolute value waveform. FIG. 8 is a block diagram showing an example of circuitry equivalent to the algorithm of the envelope follower process, which is constructed to function as a low-pass filter using different coefficients for rising and falling phases of inputs.

In the illustrated example of FIG. 8, reference numeral 60 represents a delay circuit that stores an envelope level of a last sampling cycle (i.e., a sampling cycle immediately preceding a current sampling cycle); note that the sampling cycles referred to here are those after the down-sampling process. Reference numeral 62 represents a subtracter that subtracts the envelope level of the last sampling cycle from the absolute waveform level of the current sampling cycle and provides the subtraction result as a difference signal d. 66 and 68 represent first and second multipliers, each of which multiplies the difference signal d, supplied from the subtracter 62, by a coefficient a1 or a2 (1>a1>a2). Here, the coefficient a2 of the second multiplier 68 corresponds to a filter time constant greater than the coefficient a1 of the first multiplier 66.

Figure 7B:
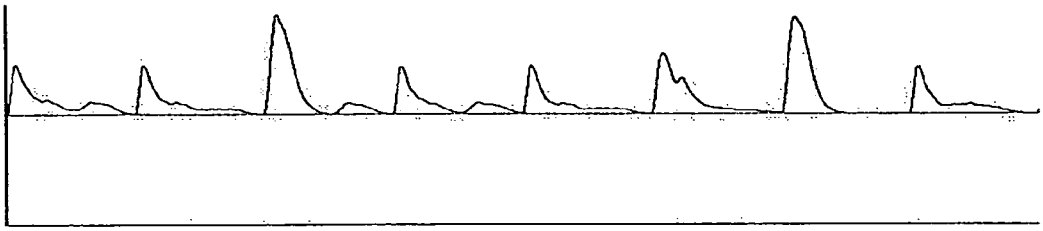
Figure 7C:
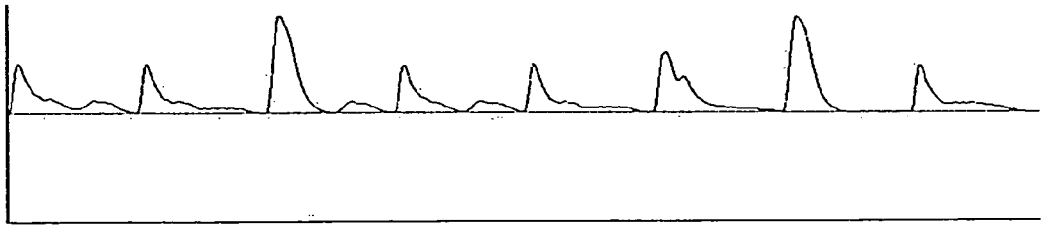

Further, a switch 64 operates to select the first multiplier 66 when the difference signal d is "0" or over but select the second multiplier 68 when the difference signal d is below "0", so as to supply the difference signal d to the selected multiplier 66 or 68. Adder 70 adds an output signal from the selected multiplier 66 or 68 and the envelope level of the last sampling cycle, and outputs the addition result as an envelope level of the current sampling cycle. In FIG. 7B, there is shown a waveform thus obtained by the envelope follower process. The waveform of FIG. 7B is further subjected to a low-pass filter operation at step SP106, and a result of this low-pass filter operation are shown in FIG. 7C.

Figure 7D:
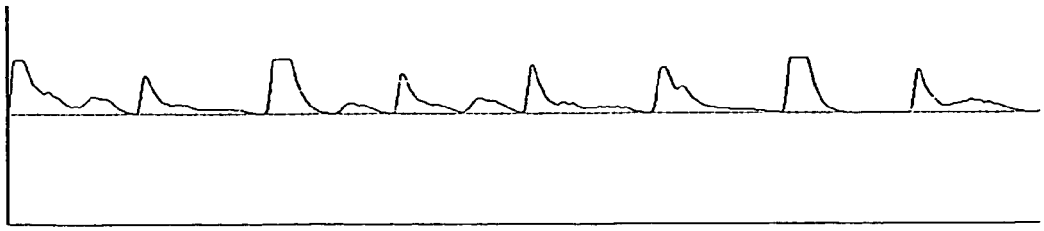

(4) Compressor Process (step SP108):

Then, at step SP108 of FIG. 6, a compressor process is carried out. Namely, in this compressor process, an average envelope level is calculated on the basis of the result of the envelope follower process of step SP106, and each envelope level greater than the average envelope level is modified to be smaller while each envelope level lower than the average envelope level is modified to be greater. Result of the compressor process is illustratively shown in FIG. 7D.

Figure 9A:
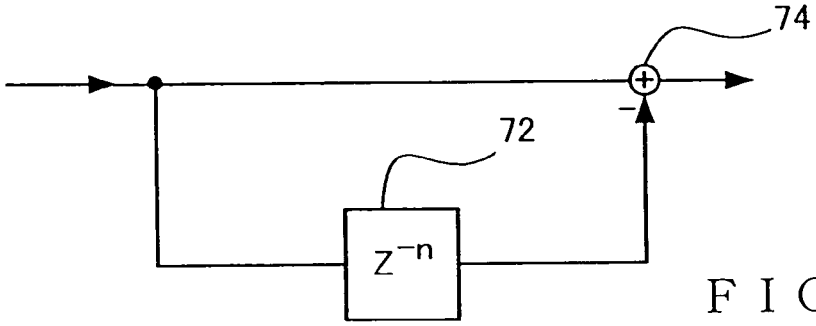
FIGS. 9A–9C are a block diagram showing an example of circuitry equivalent to an algorithm of an edge-detecting filter process performed in the first embodiment and diagrams showing waveforms produced in various parts of the circuitry.
Figure 9B:
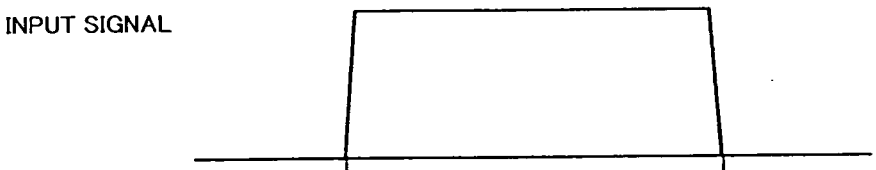
Figure 9C:
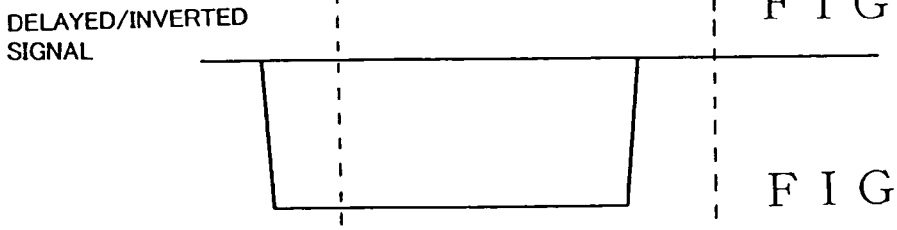
Figure 9D:
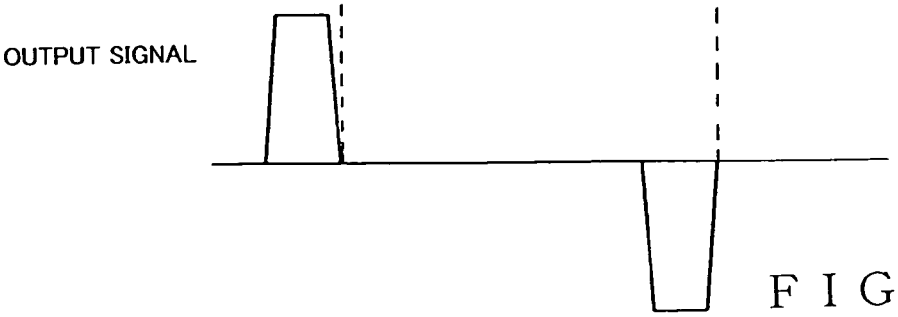
Figure 10A:
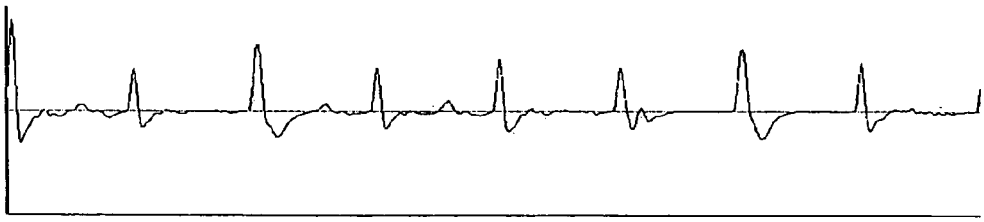
FIGS. 10A–10D are diagrams showing waveforms output from an edge-detecting filter process, edge-start-position/peak-position detection process and downbeat extraction process performed in the first embodiment.

(5) Edge-Detecting Filter Process (step SP110):

At step SP110 of FIG. 6, an edge-detecting filter process is carried out for highlighting the rise and fall portions of the envelope levels. FIG. 9A is a block diagram showing an example of circuitry (specifically, comb filter) equivalent to the algorithm of the edge-detecting filter process. In FIG. 9A, reference numeral 72 represents a delay circuit 72 that receives, as an input signal to the circuitry, the envelope level having been subjected to the compressor process and outputs the envelope level after delaying it by n (n is a natural number greater than one) sampling cycles. Reference numeral 74 represents a subtracter that subtracts the input signal of n sampling cycles before from the input signal of the current sampling cycle and outputs the difference as a result of the edge-detecting filter process. FIG. 9B shows an example of the input signal, FIG. 9C shows an example of the input signal after having been delayed by n sampling cycles and then inverted in polarity, and FIG. 9D shows an example of the output signal from the filter (i.e., the result of the subtraction between the waveforms of FIGS. 9B and 9C). Further, FIG. 10A shows a result of the edge-detecting filter process performed on the waveform of FIG. 7D.

Figure 11:
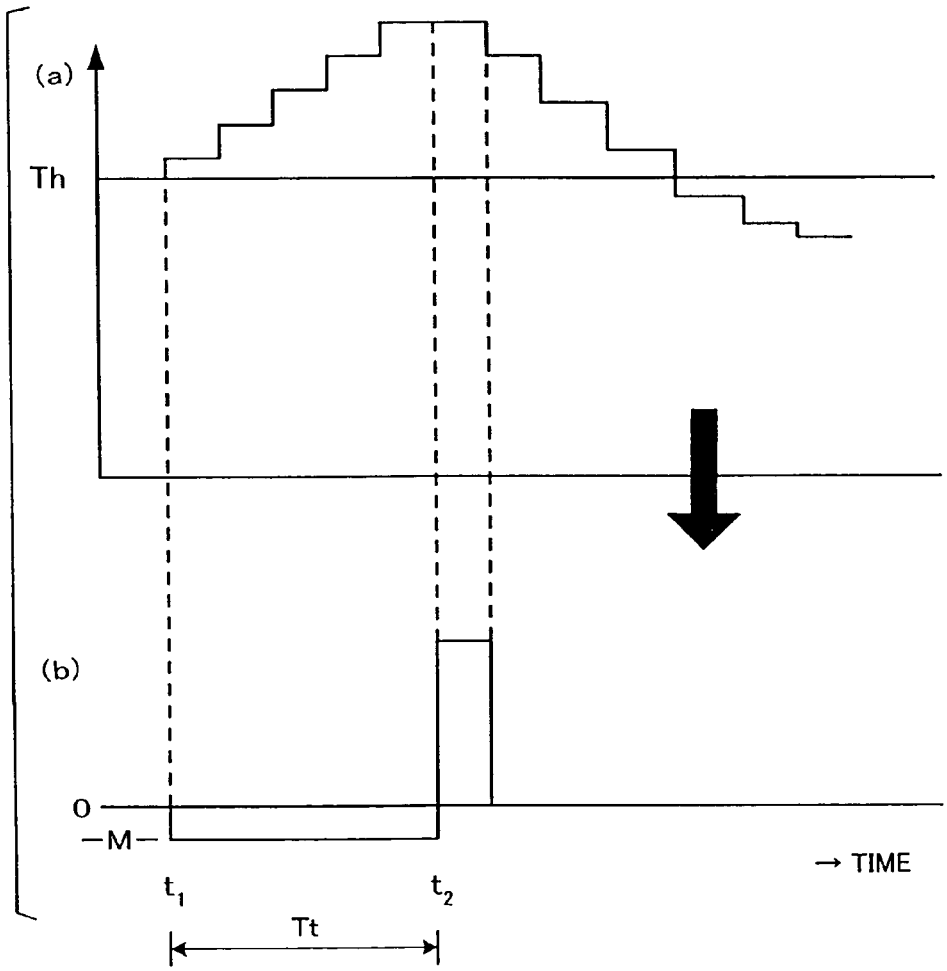
FIG. 11 is a diagram explanatory of the edge-start-position/peak-position detection process.

(6) Edge-Start-Position/Peak-Position Detection Process (step SP112):

At step SP112 of FIG. 6, an edge-start-position/peak-position detection process is carried out, which receives, as an input signal, the result of the edge-detecting filter process and detects rising edges and peak positions of the input signal. The edge-start-position/peak-position detection process is outlined below with reference to FIG. 11. Part (a) of FIG. 11 shows a portion of the input signal expanded on the time axis. Here, the input signal is compared to a predetermined threshold value Th, and a time point at which the input signal exceeds the threshold value Th is set as an edge start position (time point t1).

Output signal level shown in part (b) of FIG. 11 is kept at "0" before time point t1 and then set to a predetermined value "−M" at time point t1. Then, at the peak position of the input signal, the output signal is raised to the peak value for just one sampling cycle, and thereafter again lowered to "0". Part (b) of FIG. 11 shows a result of such operations performed on the waveform of part (a) of FIG. 11.

In the output signal shown in part (b), the time point at which the signal level is lowered to "−M" is the edge start position, and the time over which the "−M" level continues is equal to a rising time Tt from the edge start position to the peak position. Further, the peal level of the output signal is equal to the peal level in the result of the edge-detecting filter process (part (a) of FIG. 11). Note that the edge start position, rising time Tt and peak level will be hereinafter collectively called "edge information".

(7) Downbeat Extraction Process (step SP114):

At next step SP114 of FIG. 6, a downbeat extraction process is carried out. In the above-described parameter setting process of step SP6, the "musical time" parameter has been designated by the user. In this downbeat extraction process, detecting windows are determined in accordance with the designated musical time. The detecting windows have, as their respective reference positions, the start positions of individual sections of a measure divided in accordance with the designated musical time (these measure sections will hereinafter be called "presumed downbeat sections"), and each of the detecting windows has a width in a range of ⅛–½ the width of the corresponding presumed downbeat section. Which specific width in the ⅛–½ range should be used is determined in accordance with the "waveform type" parameter.

Figure 10B:
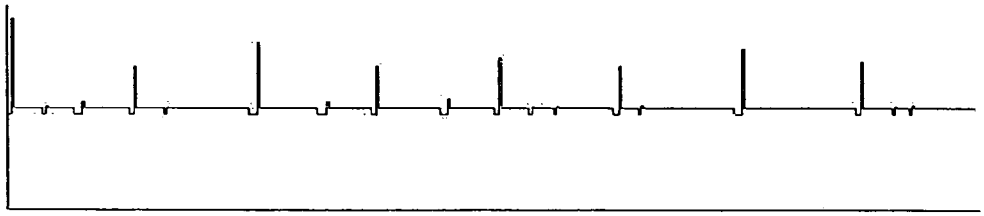
Figure 10C:
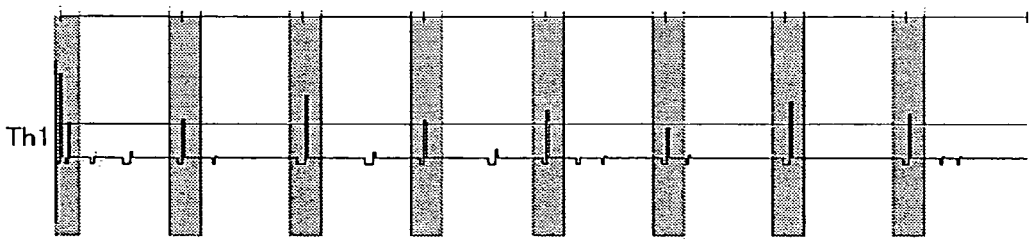

FIG. 10C shows, in overlapping relation to the waveform of FIG. 10B, the detecting windows assuming that the number of measures in the waveform data is "2", the musical time is "4/4" and the detecting window width is "⅙" of the presumed downbeat section. In FIG. 10C, the detecting windows are each denoted as a rectangular shaded area and set in such a manner that ⅓ of the detecting window (1/18 of the width of the corresponding presumed downbeat section) is located before the reference position and the remaining ⅔ (2/18 of the width of the corresponding presumed downbeat section) is located behind the reference position.

Figure 10D:
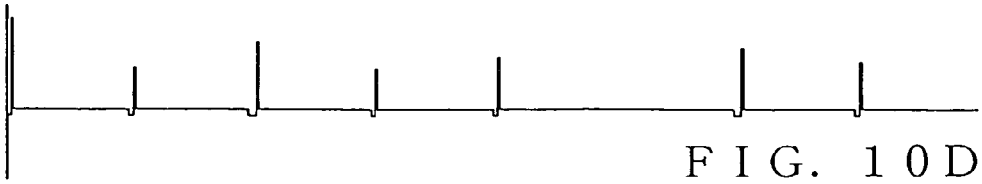

Then, in the downbeat extraction process, each edge information having the peak level greater than a predetermined first threshold value Th1 is extracted from among the edge information with the respective peak positions located within the detecting windows. However, where a plurality of pieces of the edge information are present in a same detecting window, only one of the pieces of the edge information which has the greatest peak level is extracted. FIG. 10D shows a result of the extraction operation performed on the waveform of FIG. 10C. Although two pieces of the edge information having respective peak positions greater than the threshold value Th1 are present in the first (left-end) detecting window in the illustrated example of FIG. 10C, only one of the two pieces of the edge information which has the greater peak level has been extracted in the illustrated example of FIG. 10D. Further, although edge information is present in the sixth detecting window from the left-end one in the illustrated example of FIG. 10C, the edge information has not been extracted in the illustrated example of FIG. 10D because the peak level does not exceed the threshold value Th1.

Figure 12A:
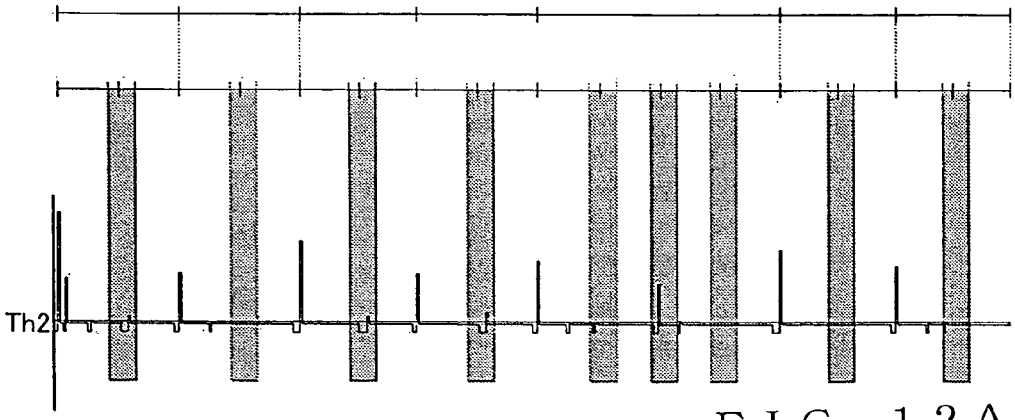
FIGS. 12A–12C are diagrams explanatory of an upbeat extraction process performed in the first embodiment and waveforms output from the extraction processes.

(8) Upbeat Extraction Process (step SP116):

At next step SP116 of FIG. 6, an upbeat extraction process is carried out. In this upbeat extraction process, the reference position of the detecting window is set at each dividing point of each measure on the basis of the "resolution" parameter designated in the above-described parameter setting process of step SP6. However, the reference positions corresponding to the detecting windows for which the downbeats have already been detected at step SP114 are excluded from consideration in the upbeat extraction process. Therefore, after the downbeats have been detected in the individual detecting windows at step SP114, the reference position is set at the point where each presumed downbeat section is halved (i.e., at the ½ position of each presumed downbeat section) in this step. Regarding the remaining detecting windows for which no downbeat has been detected earlier (e.g., the sixth detecting window from the left-end one in the illustrated example of FIG. 10C), an upbeat-extracting detecting window is set at the same position in the instant step too. As a consequence, upbeat-extracting detecting windows are set as denoted in FIG. 12A by rectangular shaded areas. Here, the positions of the upbeat-extracting detecting windows to be newly set here may be determined in accordance with the positions of the downbeat positions extracted at step SP114. In this way, even when the rhythm fluctuates halfway through the waveform data, the upbeat-extracting detecting windows can always be set at accurate positions corresponding to the current rhythm.

In this upbeat extraction process too, the detecting windows are set in such a manner that ⅓ of the detecting window (1/18 of the width of the corresponding presumed downbeat section) is located before the reference position and the remaining ⅔ (2/18 of the width of the corresponding presumed downbeat section) is located behind the reference position.

Then, in the downbeat extraction process, each edge information having the peak level greater than a predetermined second threshold value Th2 is extracted from among the edge information with the respective peak positions located within the detecting windows. However, where a plurality of pieces of the edge information are present in a same detecting window, only one of the pieces of the edge information which has the greatest peak level is extracted.

Figure 12B:
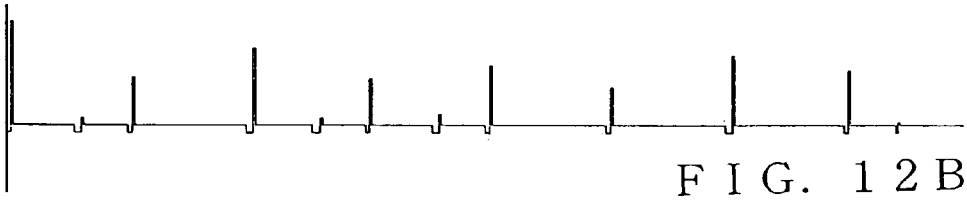
Figure 12C:
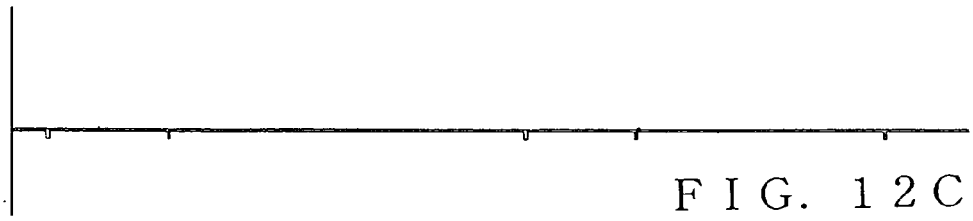

Here, the second threshold value Th2 is set to be about "⅕" of the above-mentioned first threshold value Th1, and the above-mentioned threshold value Th is set to be smaller than the threshold value Th2. FIG. 12B shows the downbeats and upbeats having been extracted by the above-described extracting processes. In the illustrated example of FIG. 12B, the edge information that could not be extracted in the downbeat extracting process of step SP114 due to a too-small peak level has been extracted by the current extracting process. Of the various edge information having been extracted in steps SP114 and SP116, the edge start positions correspond to nothing but the waveform data control points described above in relation to FIG. 2A.

(9) Compulsory Control-point Setting Process (step SP118):

At step SP118 of FIG. 6, a compulsory control-point setting process is carried out, as necessary, for compulsorily setting a control point at the reference position of each detecting window where no edge information has been detected so far. Specifically, this compulsory control-point setting process is carried out when the "sustainable-type" waveform has been designated by the user. The reason why the compulsory control-point setting process is carried out is that because the envelope of the "sustainable-type" waveform does not present regular attenuation (simple attenuation), time-axial control more appropriate from a musical point of view will be performed if control points are compulsorily set also at positions where no rise has been detected.

2.2.5. Control-point Editing Process (step SP14):

At step SP14 of FIG. 4, the default control points are edited by the user. Specifically, waveform data control points are added, deleted or moved on the detecting windows, as necessary.

Figure 2C:
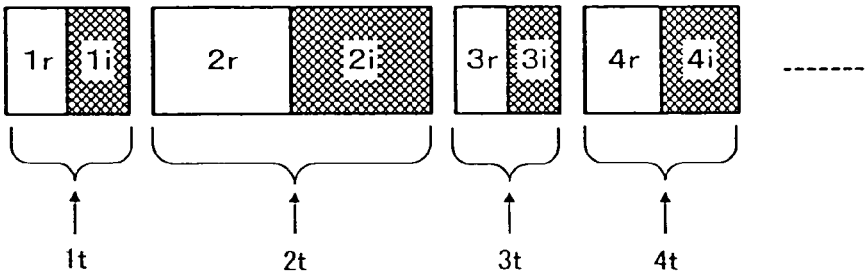

2.2.6. Determination of Smoothed Waveform Data for Inserting sections 1*i*–12*i*:

As stated above, the sections of the waveform data divided at the start and end positions and control points are called here "original sections". After the control points have been determined as shown in FIG. 2A, the waveform data are divided into 12 original sections 1*r*–12*r* as shown in an upper row of rectangular blocks in FIG. 2B. Then, the 12 inserting sections 1*i*–12*i* having the same lengths as the respective the original sections 1*r*–12*r* are created as shown in a lower row of rectangular blocks in FIG. 2B, and such waveform data as to practically continue from the waveform data of the corresponding original sections 1*r*–12*r* are stored in the individual inserting sections 1*i*–12*i*. Thus, there can be obtained coupled sections 1*t*–12*t* as shown in FIG. 2C by coupling the original sections 1*r*–12*r* with the corresponding inserting sections 1*i*–12*i*. Details of these operations are given below.

Figure 13A:
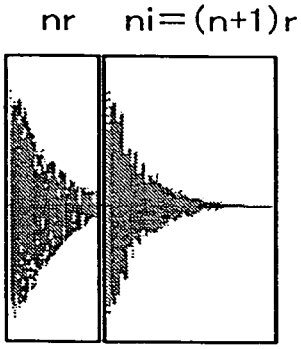
FIGS. 13A and 13B are diagrams explanatory of a process performed in the first embodiment for setting waveform data in an inserting section.
Figure 13B:
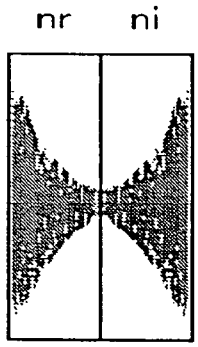

Referring back to FIG. 4, the user, at step SP16, selects either one of the following as waveform data (waveform data prior to envelope adjustment) to be set in each of the inserting sections 1*i*–12*i*:

(1) direct duplication of waveform data of the original section (n+1)r immediately following the waveform data of the corresponding original section nr (n is any one of values 1–12) as shown in FIG. 13A; and (2) waveform data obtained by inverting the waveform data of the corresponding original section nr on the time axis as shown in FIG. 13B.

In the default state, the user selects the waveform data illustrated in FIG. 13A if the waveform type is the "sustainable type" but selects the waveform data illustrated in FIG. 13B if the waveform type is the "percussion type", for reasons stated below.

<Sustainable-type Tone>

In the case of a sustainable-type tone, a smooth connection from the original section nr to the inserting section (n+1)r is assured because these original section nr and inserting section (n+1)r are originally successive sections. Although another section than the inserting section (n+1)r can be used as an inserting section, a waveform data control point may sometimes be set in a portion of the sustainable tone that has no attack phase (i.e., halfway through the sustainable-type waveform)(see step SP118), and such a situation should also be taken into consideration. Namely, in case the original section nr and inserting section are out of phase, there would be produced noise offensive to the ears. Thus, a need arises for adjusting the phases of the two sections to coincide with each other, which makes the processing more complicated. However, if the section (n+1)r immediately following the original section nr is used as an inserting section as in the above-described example, then waveform data of the inserting section can be created on the basis of more stable waveform data.

Let's now suppose a case where a given waveform data control point of the sustainable-type tone is immediately followed by an attack portion of a next tone. Generally, in such a case, the next tone differs in pitch from the preceding tone. Although a pitch difference between the original section and the corresponding inserting section is essentially undesirable, experimental results have revealed that such a pitch different does not become so noticeable. This is probably attributable to the fact that the envelope level of the inserting section is controlled to attenuate smoothly from the preceding original section. That is, variations in color (timbre) and pitch at an attack phase of a newly produced tone generally tend to become noticeable, but, if the color or pitch changes halfway through an attenuating waveform, the color or pitch change will not become so noticeable because of a strong impression of the preceding attack portion.

<Percussion-type Tone>

In the case of a percussion-type tone, no noticeable noise is often produced in a connection from the original section nr to the corresponding inserting section ni because the percussion-type tone inherently has a lot of noise-like components. However, if the original section nr, next original section (n+1)r or the like is used as it is as the inserting section ni, then attack noise in a leading portion of the waveform may become more or less offensive to the ears. Such an inconvenience can be eliminated by using, as data of the inserting section ni, waveform data obtained by inverting the waveform data of the original section nr on the time axis. The original section nr and the inserting section ni can be interconnected even more smoothly if connecting portions of the two sections are interconnected in a cross-fading fashion. Note that reading out the inverted waveform data up to the end of the data will reproduce attack noise in an end portion of the inverted waveform data, which may become slightly offensive to the ears. In such a case, the waveform data may be read out by turning back (further inverting, on the time axis, the data at a halfway point (e.g., point corresponding to about a ⅔ length from the beginning) of the inverted waveform data.

The inserting sections are not necessarily limited to the above-described default inserting sections and inserting sections optimal to the human auditory sense may be selected, because the user is allowed to designate a desired mode for creating an inserting section per original section. Further, when waveform data of the inserting sections have been selected, levels in individual portions of the waveform data are divided by envelope levels of the waveform data, at step SP16. In this way, the waveform data of the inserting sections are converted into waveform data of flat envelopes.

Figure 14:
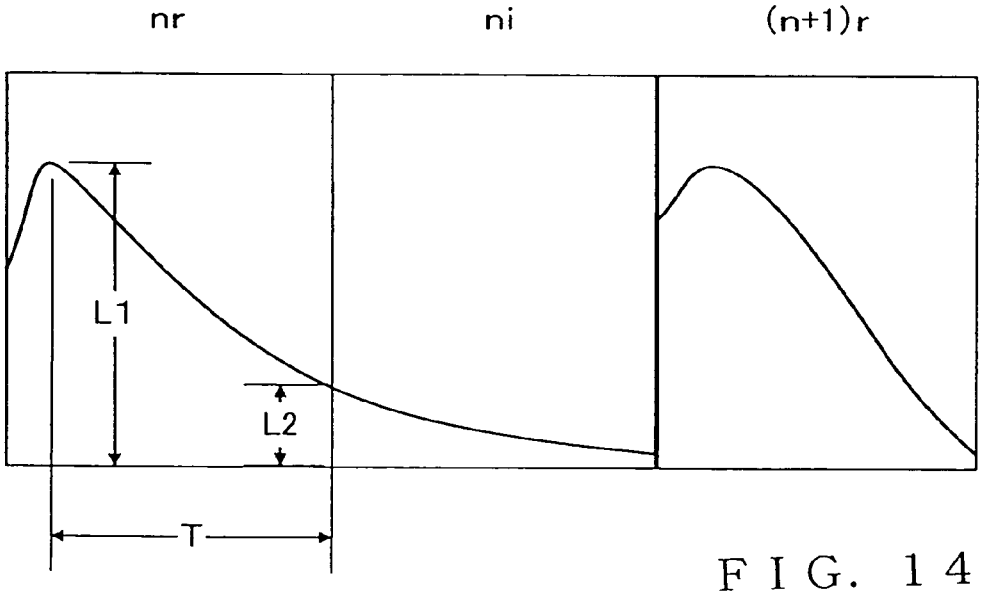
FIG. 14 is a diagram explanatory of a process performed in the first embodiment for setting envelope levels in the inserting section.

2.2.7. Envelope Impartment to Inserting Sections 1*i*–12*i*:

At next step SP18 of FIG. 4, envelope shapes for the inserting sections 1*i*–12*i* are determined in a manner as described below with reference to FIG. 14. In FIG. 14, it is assumed that the maximum envelope level value of a given original section nr is "L1", the envelope level value at the end of the original section nr is "L2" and a length of a time period from occurrence of the maximum envelope level value "L1" to the end of the original section nr is "T". Attenuation rate dr of the envelope level within this time period can be determined by $$dr=(L1/L2)^{1/T}$$

Then, the initial envelope level value of the inserting section ni corresponding to the original section nr is set to the above-mentioned value "L2", and an envelope of the inserting section ni is determined such that the attenuation rate dr is maintained. Specifically, if a start time position t of the inserting section ni is set to "0" (t=0), the envelope level of each portion in the inserting section ni can be determined by $L2/dr^t$. Thus, as shown in FIG. 14. Envelope characteristics of the inserting section ni are set in such a manner that the inserting section ni can be connected with the original section nr in a natural manner.

However, in the event that the simple determination mode has been selected, it is conceivable that the envelope level takes a greatest value at the end of the original section nr. In such a case, the envelope level of the inserting section ni is limited to the level at the end of the original section nr. Specifically, where the attenuation rate dr determined by the above mathematical expression is smaller than "1", the attenuation rate dr to be used for determining envelope levels of the inserting section may be compulsorily set to "1", or a lower limit value "Dr_min" greater than "1" may be predetermined as regards the attenuation rate dr so as to control the attenuation rate dr to always exceed the lower limit value "Dr_min".

Once the envelops of the individual inserting sections have been determined in the above-described manner, the smoothed waveform data of the inserting sections 1*i*–12*i* are multiplied by the thus-determined envelopes. As a consequence, the waveform data of the individual inserting sections are caused to assume the respective determined envelopes.

Figures 16, 17:
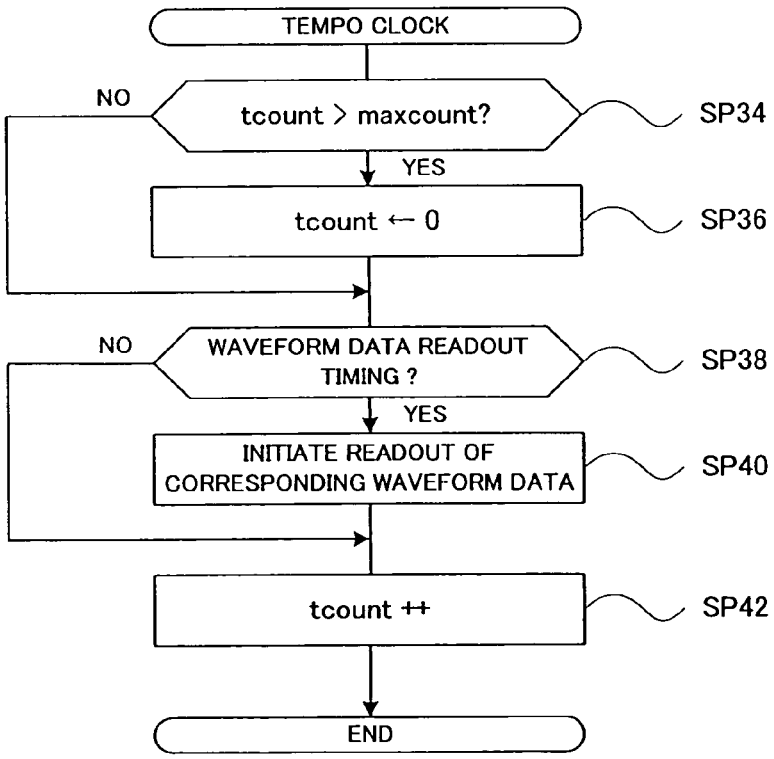
FIG. 16 is a diagram showing a table storing correspondency between waveform-data-generation-start triggering clock counts and waveform data.
FIG. 17 is a flow chart of a performance process routine performed in the first embodiment.

At next step SP20 of FIG. 4, parameters are determined which are used for reading out the waveform data of the coupled sections 1*t*–12*t* at the time of an automatic performance. In the automatic performance, tempo clocks are generated at intervals of "1/64" of a quarter note, and an automatic performance is carried out in synchronism with the thus-generated tempo clocks. Here, a maximum count of clocks maxcount, corresponding to a repetition period for waveform data reproduction is determined in accordance with the musical time and number of measures having been determined at steps SP6 and SP8. For example, if the musical time is "4/4" and the number of measures is "2", the maximum count of clocks maxcount amounts to 512 (4×2×64=512). After that, various data are stored in a table as shown in FIG. 16, such as data indicative of the start point of the waveform data, predetermined counts of clocks representing times from the start to the individual waveform data control points (i.e., waveform-data-reproduction-start triggering clock counts), waveform data to be reproduced at the timing indicated by the clock counts and respective rising times Tt of the waveform data. After that, the to-be-reproduced-waveform data generating processing routine is brought to an end.

2.3. Reproducing Tempo Setting/Variation Process:

In the above-described processing, the desired musical time and number of measures have been set for the recorded waveform data, and the maximum clock count maxcount has been set in accordance with the thus-set musical time and number of measures. Because the absolute time length of the waveform data is already known, the tempo with which the waveform data were originally recorded (i.e., original recording tempo of the waveform data) can be calculated by reverse arithmetic operations.

Regardless of the original recording tempo, the user is allowed to set or vary a reproducing tempo as desired prior to or in the course of the performance processing. If the thus-set reproducing tempo is equal to the original recording tempo, the clock counts determined earlier (see FIG. 16) may be used as they are. However, if the set reproducing tempo is not equal to the original recording tempo, there will be produced a sense of "tardiness" or "heaviness" as explained below with reference to FIG. 3A.

Figure 3A:
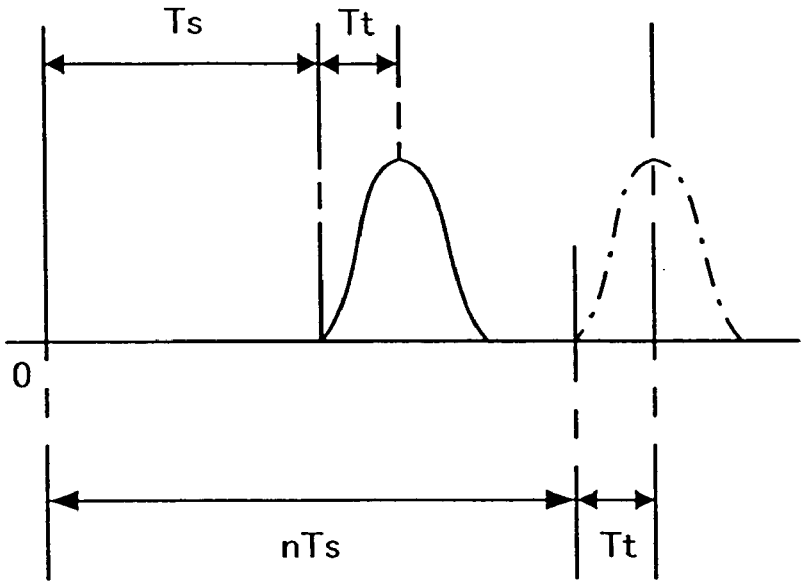
FIGS. 3A and 3B are diagrams explanatory of reproduction processing performed in the first embodiment.

Namely, in the case where the original recording tempo and reproducing tempo are different from each other, controlling the reproduction start timing of the individual sections merely in accordance with a ratio between the two tempos will result in a sense of "tardiness" or "heaviness" particularly in a waveform having a slow rise, as seen from FIG. 3A. In the illustrated example of FIG. 3A, reference character Ts represents a length of an edge start time period from a reproduction start time point (0) to a rise start time point, and Tt represents a rising time from the rise start time point to a time point when the waveform level reaches a peak. Solid-line curve represents a changing envelope level of the waveform data reproduced at the same tempo as when the waveform data were originally recorded. With the human auditory sense, a listener would feel as if a beat occurred at a time point when a time "Ts+Tt" had elapsed after the reproduction start. Dash-and-dot-line curve of FIG. 3A, on the other hand, denotes an example of waveform data reproduced by expanding the original recording tempo by a factor of "n", assuming that n=2. In this case, although the length of the edge start time period is n times the original one for the waveform data recording (i.e., nTs), the time when the human auditory sense actually feels the beat becomes "nTs+Tt" shorter than n times the time "Ts+Tt" (i.e., n(Ts+Tt)). Thus, if the waveform is reproduced with an expanded tempo, the human listener feels as if the beat occurred at timing earlier than preferred timing. Conversely, if the waveform is reproduced with a compressed tempo, the human listener feels as if the beat occurred at timing later than the preferred timing.

Figure 3B:
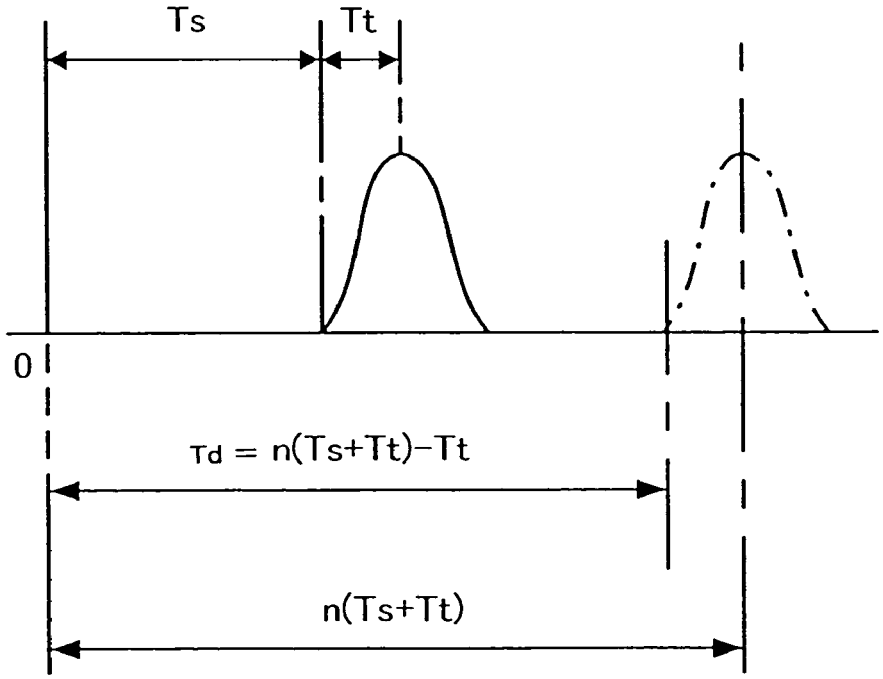

So, when a reproducing tempo has been set or varied in the instant embodiment, each of the predetermined counts of clocks representing the timing for reproducing the waveform data (i.e., waveform-data-reproduction-start triggering clock counts) shown in FIG. 16 is modified so that the time corresponding to the clock count (clock count×clock period) becomes "(n(Ts+Tt)−Tt". Namely, as shown in FIG. 3B, a time difference Td between the start position of the original waveform and the start position of the current dividing position at the time of reproduction becomes Td=n(Ts+Tt)−Tt. Consequently, as shown in FIG. 3B, the beat, i.e. peak position, felt by the auditory sense falls at a time point when an additional time equal to the rising time Tt has passed (i.e., n(Ts+Tt)). Note that the clock period may be increased or decreased in accordance with the rising time Tt in stead of the waveform-data-generation-start triggering-clock count being varied in accordance with the tempo. Namely, each time a tempo clock is generated, the period from the current generated tempo clock to a next tempo clock may be increased or decreased as appropriate so that it is possible to perform timing control corresponding to the tempo while leaving unchanged the waveform-data-generation-start triggering clock count itself.

2.4. Performance Process:

The following paragraphs describe a process for carrying out an automatic performance using the waveform data of the coupled sections 1*t*–12*t*, with reference to FIG. 17. During the automatic performance, tempo clocks are generated at intervals of "1/64" of a quarter note as noted earlier, and the routine of FIG. 17 is executed in response to generation of each tempo clock. At step SP34 of FIG. 17, a determination is made as to whether a variable tcount has exceeded the maximum clock count maxcount. Note that the variable tcount has been initialized to a value "0" at the beginning of the automatic performance. With an affirmative (YES) determination at step SP34, the routine goes to step SP36, where the variable tcount is set to "0". If, on the other hand, a negative (NO) determination has been made at step SP34, the operation of step SP36 is omitted.

At next step SP38 of FIG. 17, reference is made to the table of FIG. 16, and a determination is made as to whether or not predetermined timing for initiating readout of the waveform data has arrived, i.e. whether or not the value of the variable tcount currently coincides with any one of the waveform-data-generation-start triggering clock counts. With an YES determination at step SP38, the process proceeds to step SP40, where readout of the corresponding waveform data is initiated. Here, the waveform data readout rate is controlled in accordance with a value of a pitch shift amount as will be described later. If the pitch shift amount is "0", the waveform data readout rate is set to the same rate as the data writing rate at which the waveform data were originally recorded (original data write rate). If the pitch shift amount is of a positive value, the waveform data readout rate is set to be higher than the original data write rate, while if the pitch shift amount is of a negative value, the waveform data readout rate is set to be lower than the original data write rate. As well known in the art, the pitch of the read-out waveform data becomes higher as the waveform data readout rate gets higher, but becomes lower as the waveform data readout rate gets lower.

Thus, even when some other waveform data were being read out till just before the current time point, readout of new waveform data can be initiated at step SP40 in such a manner as to replace the other waveform data. If answered in the negative at step SP38, the operation of step SP40 is omitted, so that the routine goes to step SP42 without the currently read-out waveform data being replaced. At step SP42, the variable tcount is incremented by one, after which the instant routine is brought to an end.

In the instant performance process, the waveform data readout of the coupled section it is initiated as soon as the routine goes to step SP38 for the first time after initialization, to the "0" value, of the variable tcount. Thereafter, when the process goes to step SP38 after the variable tcount has reached a value "28", the waveform data readout of the coupled section it is terminated, so that the waveform data readout of the next coupled section 2*t* is initiated. To provide a smooth connection between the successive coupled sections 1*t* and 2*t*, the waveform data of a portion of the coupled section 1*t* where the data readout is to be terminated and the waveform data of a portion of the next coupled section 2*t* where the data readout is to be initiated may be interconnected in a cross-fading fashion.

In the same manner, waveform data readout of the following coupled sections 3*t*–12*t* is initiated sequentially in accordance with increment in the value of the variable tcount. Then, once the variable tcount reaches a value "maxcount+1" as determined at step SP34, it is reset to "0" at step SP36. After that, operations similar to the above-described are repeated. The thus sequentially-readout waveform data are sequentially audibly reproduced via the waveform output interface 26 and sound system 28.

Figure 18:
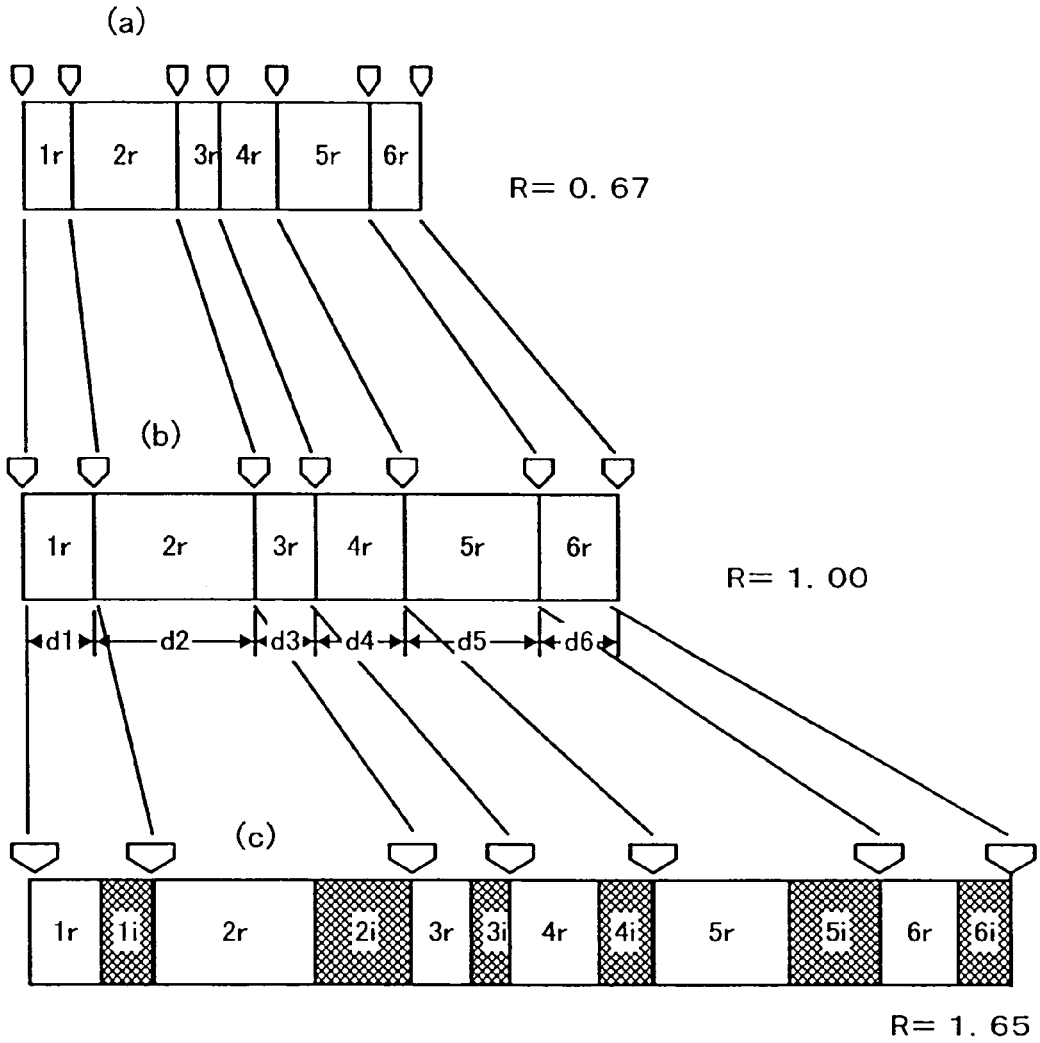
FIG. 18 is a diagram explanatory of a process performed in the first embodiment for compressing/expanding waveform data to be reproduced.

The following paragraphs describe a tone waveform actually generated through such operations, with reference to FIG. 18. Part (b) of FIG. 18 shows sections read out when a ratio of the reproducing tempo to the original recording tempo is set to "1.00". In this case, when one half (½) of one of the coupled sections has been read out, i.e. when a portion of the coupled section that corresponds to the whole of an original section has been read out, readout of the next coupled section is initiated. In this way, the reproduced tone waveform agrees with the original waveform data.

Part (a) of FIG. 18 shows sections read out when the ratio of the reproducing tempo to the original recording tempo is set to "0.67". In this case, when a portion of one of the coupled sections that corresponds to about "67%" of the length of a single original section has been read out, readout of the next coupled section is initiated. As noted earlier, the timing at which the readout of the next coupled section is initiated differs depending on the rising time Tt. In this way, the remaining portion (about 33%) of each of the original sections and the inserting sections are left unreproduced.

Further, part (c) of FIG. 18 shows sections read out when the ratio of the reproducing tempo to the original recording tempo is set to "1.65". In this case, when a portion of one of the coupled sections that corresponds to about "165%" of the length of a single original section has been read out, readout of the next coupled section is initiated. In this way, all of the original sections and about first 65% of each of the inserting sections are reproduced.

The reproducing tempo and the waveform data to be reproduced can be varied in real time by the user via the input device 4. Similarly, the rate at which to read out the individual sections, i.e. the pitch shift amount, can be varied in real time by the user via the input device 4. Alternatively, the waveform data to be reproduced, reproducing tempo or pitch shift amount may be varied automatically. In this way, the waveform data can be reproductively sounded in any one of a variety of manners on the basis of user operation or a predetermined sequence.

3. Advantageous Results of First Embodiment:

Because the instant embodiment is arranged to detect waveform data control points of waveform data after having performed the filter process on the waveform data, it can extract optimal waveform data control points corresponding to characteristics of the individual waveform data. Further, in the instant embodiment, reproduction of each of the original sections can be initiated at the timing "n(Ts+Tt)−Tt" by modifying the waveform-data-generation-start triggering clock count in accordance with relationship between the original edge start time Ts and rising time Tt and the reproducing tempo (tempo expansion/compression ratio n), and thus it is possible to secure appropriate consistency between the tempo expansion/compression ratio n and beat timing actually felt by the human auditory sense.

4. Modifications of First Embodiment:

It should be appreciated that the present invention is not limited to the scope of the above-described first embodiment and various modifications of the first embodiment are also possible as set forth below.

(1) Whereas the embodiment has been described as implementing an inventive waveform editing system by an application program run on a personal computer, similar functions may be applied to various electronic musical instruments, mobile cellular telephones, amusement equipment and other tone generating apparatus. Further, the software used in the above-described embodiment may be distributed in storage media such as CD-ROMs and floppy disks, or via data communication paths.

(2) Whereas the embodiment has been described as previously generating waveform data of the inserting sections in corresponding relation to the original sections, the waveform data of the individual inserting sections may be generated during reproduction of the waveform data of the corresponding original sections, or immediately before initiation of the reproduction of the waveform data of the corresponding original sections. This modification can reduce the necessary storage capacity for storing the waveform data.

(3) The "number-of-measure" parameter in the embodiment has been described as designated using a natural number. This is because the length of the waveform data can hardly be other than natural number multiples of a measure in applications where the waveform data are reproduced repetitively. In other possible applications where the waveform data are reproduced in a so-called "one shot" fashion, however, it is not always necessary to perform the trimming operations such that the number of measures becomes a natural number multiple. In such a case, it is likely that the number of measures is not a natural number, and, therefore, arrangements may be made such that the number-of-measure parameter can be designated in a decimal. Alternatively, the number of beats in the whole of the trimmed waveform data may be designated in place of the number of measures.

Further, the trimming operations need not necessarily be performed on the beat-by-beat basis. To practice the present invention, it is only necessary that positions, on the original waveform data, of the beat detecting windows be specified (see FIGS. 10C and 12A); thus, the trimming operations may be performed in any desired manner, and positions of the beat detecting windows may be specified in any desired manner. For example, desired positions, on the original waveform data, of the beat detecting windows may be designated directly by the user, or automatically on the basis of timing indicated by metronome data; in the latter case, a metronome may be used during recording of the original waveform data.

(4) Further, the unnecessary-band removing process of step SP8 in the embodiment has been described as performing the high-pass and band cut filter processes. However, in the unnecessary-band removing process, any other process, such as an operation for attenuating low-frequency components or boosting high-frequency components, may be performed in place of or in addition to the high-pass or band cut filter process.

(5) Further, whereas the embodiment has been described as performing, at step SP110, the comb-filter-based filter process for detecting edge portions, the edge portions may be detected by any other suitable filter process that is arranged to generate values corresponding to envelope inclinations. For example, there may be performed a filter process for simply differentiating the envelope levels, and a low-pass filter process for processing the differentiated results.

(6) At step SP116 in the above-described embodiment, the reference positions of the upbeat detecting windows are set at a ½ position of each presumed downbeat section (namely, position dividing the presumed downbeat section into two equal portions), i.e. at a ½ position in between the reference positions for detecting downbeats. However, the upbeat detecting windows are not limited to such positions.

Namely, a point halving an interval between successive downbeat edge start positions or peak positions actually extracted at step SP114 may be obtained so that the thus-determined position is set as the reference position of the upbeat detecting window.

(7) Step SP16 in the instant embodiment has been described as using, as the waveform data of the inserting section prior to envelope adjustment, the waveform data of the corresponding section as they are or after inversion. However, in the case of waveform data of a melody part or the like having particularly stable pitch components, an inserting section may be created by detecting a pitch of a latter portion of the original section and repeating a portion (partial waveform) of the original section in accordance with the basis of the detected pitch. In this way, it is possible to prevent instability specific to an attack portion from appearing in the inserting section.

Note that the partial waveform may be of either a fixed length (loop waveform) or a randomly variable length. In case no stable pitch has been detected in the latter portion of the original section, a proportion of the waveform data of the original section may be repeated. Further, in case no pitch has been detected at all, the whole of the waveform data (or inverted version of the waveform data) of the original section may be copied and set as the waveform data of the inserting section prior to envelope adjustment.

(8) Further, in the above-described embodiment, each of the inserting sections is created on the basis of the waveform data (or inverted version thereof) of the immediately preceding original section. In an alternative, each of the inserting sections may be created on the basis of the waveform data of the original section immediately following the inserting section; for example, the inserting section 1*i* may be created on the basis of the waveform data of the next original section 2*r*.

(9) Furthermore, whereas the embodiment has been described as classifying the waveform data into two major types, "percussion type" and "sustainable type", the waveform data may be classified into three or more types.

(10) Furthermore, whereas the embodiment has been described as setting the downbeat detecting windows in accordance with the musical time setting and setting the upbeat detecting windows in accordance with the resolution setting, these detecting windows need not necessarily be set in accordance with the musical time or resolution. For example, the downbeat detecting windows and upbeat detecting windows may be designated independently of each other, or the downbeat detecting windows and upbeat detecting windows may be designated in accordance with the set musical time. In another alternative, the downbeat detecting windows and upbeat detecting windows may be designated on the basis of timing indicated by metronome data recorded during recording of the original waveform data as noted above.

With the above-described arrangement that waveform data dividing positions of the waveform data are determined on the basis of the envelope levels of the waveform data having been subjected to the filter process, the present invention can efficiently extract effective rise positions as the waveform data dividing positions, using filter characteristics corresponding to a type of a music piece in question.

Further, by differentiating the envelope shape of the waveform data having been subjected to the filter process, the present invention can extract the effective rise positions with further increased efficiency. Furthermore, by further including the amplitude conversion process for reducing amplitude differences in the envelop waveforms, the present invention can accurately determine the waveform data dividing positions on the basis of the rising rates while reducing differences in the rising rates.

Furthermore, by the arrangement of determining the waveform data dividing positions and corresponding peak levels on the basis of results of the envelope shape differentiation, the present invention can determine the waveform data dividing positions by selecting rise positions on the basis of the peak levels. Moreover, with the arrangement that reproduction of the waveform data following the waveform data dividing position is initiate upon lapse of the time "n(Ts+Tt)−Tt", the present invention can set a beat position or peak position, to be felt by the human auditory sense, at an optimal position in accordance with the expansion ratio n.

Furthermore, with the arrangement that a predetermined one of the rise positions of the original waveform data, belonging to a predetermined range, is extracted as a dividing position, the present invention can efficiently extract effective rise positions as the waveform data dividing positions. Also, by extracting the rise positions in correspondence with the presumed beat positions, the present invention can detect the rise positions in a stable manner while effectively preventing erroneous detection. Stated differently, positions that are located near originally expected dividing positions and also considered to be appropriate from a musical point of view can be set as the waveform data dividing positions.

Furthermore, with the arrangement that one of a plurality of rise positions belonging to a predetermined range is selected and extracted as a waveform data dividing position of the original waveform data, the present invention can efficiently eliminate any unnecessary rise positions. Moreover, with the arrangement that a rise position belonging to a predetermined range is extracted as a waveform data dividing position on condition that level values corresponding to the rise position exceed a predetermined first threshold value, the present invention can extract a rise position of a greater level value with higher priority. Furthermore, by re-extracting a waveform data dividing position on the basis of a second threshold value after the extraction based on the first threshold value, the present invention can extract a finer waveform data dividing position. As compared to a case where the lower threshold value is used from the beginning, the present invention can reduce erroneous detection more reliably. Furthermore, by the arrangement of extracting a waveform data dividing position by applying the first and second threshold values to first and second predetermined ranges, respectively, the present invention can extract a waveform data dividing position by use of optimal threshold values corresponding to points where variation in beat intensity is likely to occur.

Figure 20:
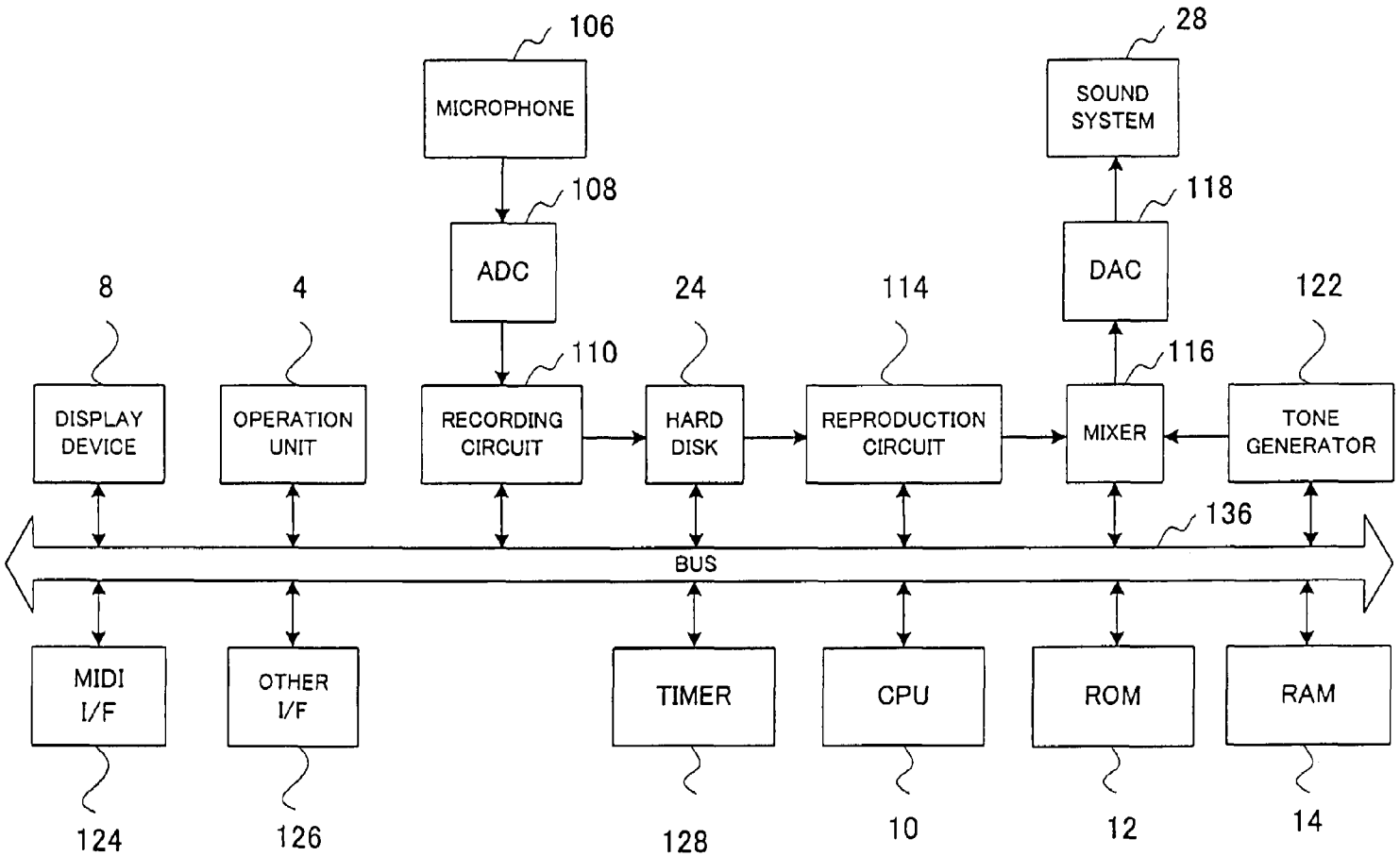
FIG. 20 is a block diagram showing an exemplary general hardware setup of a waveform editing system in accordance with a second embodiment of the present invention.

5. Second Embodiment:

FIG. 20 is a block diagram showing an exemplary general hardware setup of a waveform editing system in accordance with a second embodiment of the present invention. Same reference numerals as used in FIG. 1 represent elements of the same functions as in FIG. 1. In the figure, reference numeral 106 represents a microphone that picks up a tone signal (analog waveform) of a natural musical instrument or the like. 108 represents an A/D converter (ADC) that converts the analog waveform into a digital signal. Recording circuit 110 directly accesses a hard disk 24 (, i.e. performs a DMA operation on the hard disk 24) to store the digital signal, as waveform data, on the hard disk 24. Reproduction circuit 114 directly accesses the hard disk 24 (performs DMA operation on the hard disk 24) to read out, from the hard disk 24, waveform data to be reproduced and supply the read-out waveform data to a mixer 116. Tone generator 122 synthesizes a tone signal on the basis of performance information supplied via a bus 136 and supplies the thus-synthesized tone signal to the mixer 116. The mixer 116 mixes the waveform data and tone signal supplied from the reproduction circuit 114 and tone generator 122.

D/A converter (DAC) 118 converts the mixed result of the mixer 116 into an analog signal that is then sounded via a sound system 28. Reference numeral 124 represents a MIDI interface that communicates MIDI signals with external MIDI equipment, and 126 represents another interface that communicates waveform data with external equipment. Timer 128 generates a timer interrupt signal every predetermined timing.

6. Behavior of Second Embodiment:

The following paragraphs describe behavior of the second embodiment. Upon powering-on of a personal computer constituting the waveform editing system, an initial loader program stored in a ROM 12 is executed so that an operating system is started up. Once predetermined operation is performed by the user while the operating system is ON, a waveform-editing application program is triggered. Then, once the user performs predetermined operation while the waveform-editing application program is ON, an automatic performance/waveform recording processing routine shown in FIG. 21 is started up.

Figure 21:
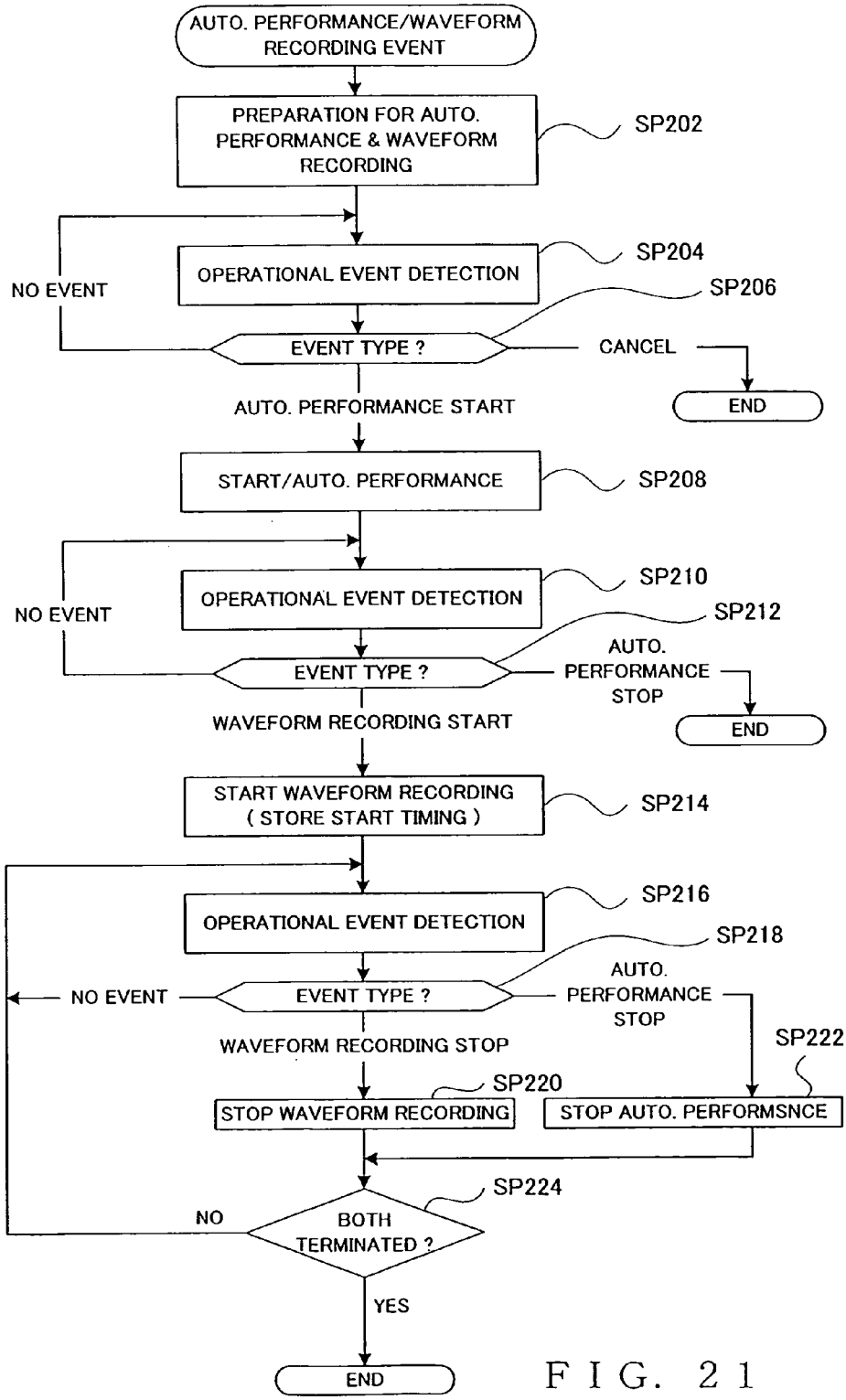
FIG. 21 is a flow chart of an automatic performance/waveform recording processing routine performed in the second embodiment.
Figure 22:
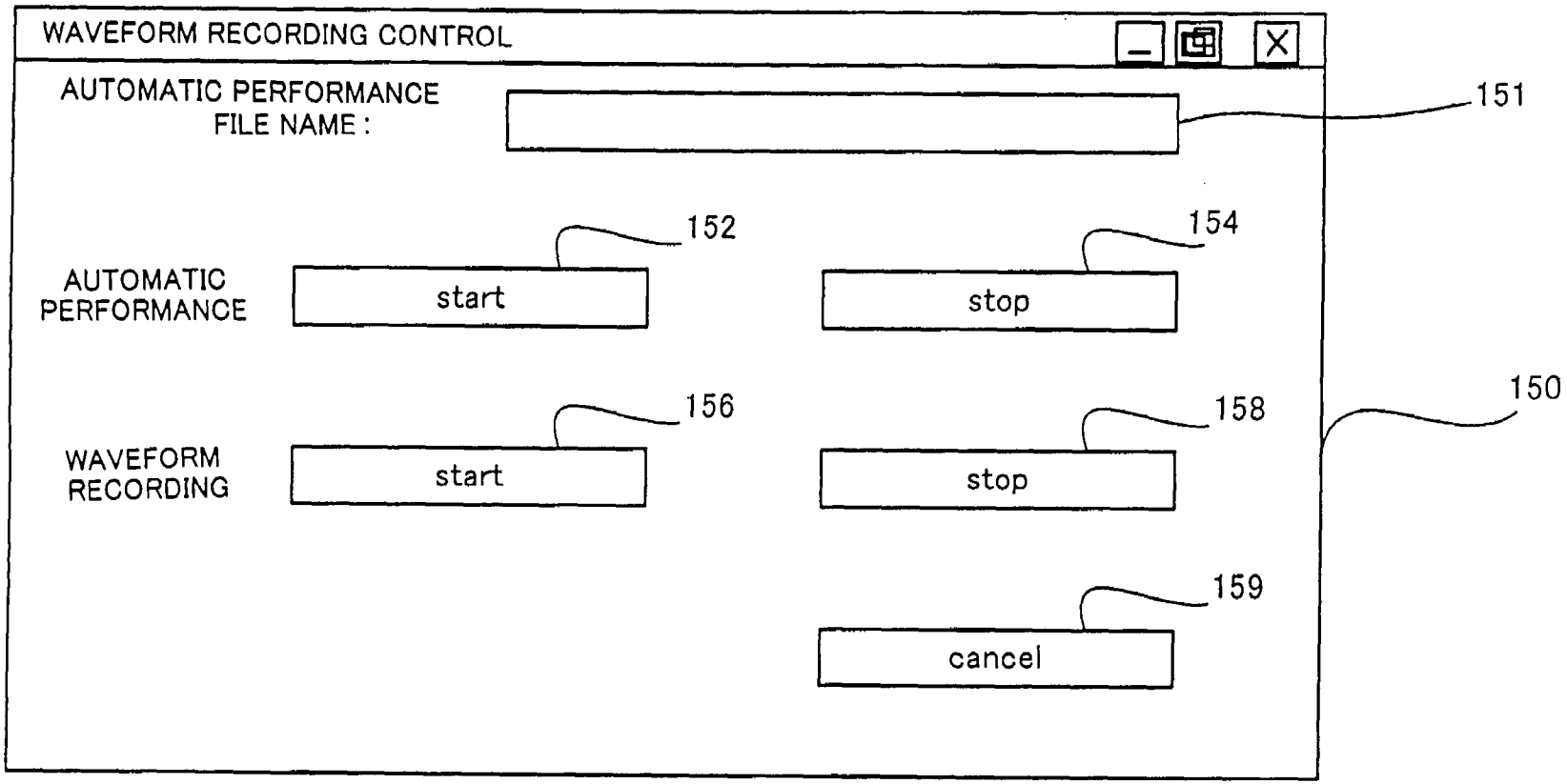
FIG. 22 is a diagram showing an example of a waveform recording control window displayed on a display device in the second embodiment.

At step SP202 of FIG. 21, a preparation process is carried out to make necessary preparations for an automatic performance and waveform recording, and a waveform recording control window 150 is displayed on a display device 8 as shown in FIG. 22. On the waveform recording control window 150, there is provided an automatic performance file text box 151 to be used for the user to designate an automatic performance file name. Further, on the waveform recording control window 150, an automatic performance start button 152 is provided for the user to instruct initiation of reproduction of the designated automatic performance file, and an automatic performance stop button 152 is provided for the user to instruct termination of the designated automatic performance file. Also provided on the waveform recording control window 150 are a waveform recording start button 156 for the user to instruct initiation of waveform recording by means of the A/D converter 108 and recording circuit 110, a waveform recording stop button 158 for the user to instruct termination of the waveform recording, and a cancel button 159 for the user to instruct cancellation of all operations being performed in the waveform editing system. Under initial conditions of the waveform recording control window 150, only the automatic performance file text box 151 is set in an ON or active (operable) state, and all of the other buttons 152–159 are set in an OFF or inactive (non-operable) state. Once the user enters an appropriate name of a desired automatic performance text file prepared, for example, in the SMF (Standard MIDI file format), the automatic performance stop button 152 and cancel button 159 are set in the active state while the other buttons or window elements on the control window 150 are set in the inactive state.

At next step SP204 of FIG. 21, detection is made of operational events of the window elements currently set in the active state on the waveform recording control window 150. Then, at step SP206, the routine branches in accordance with a result of the detection at step SP204. If no operational event has been detected, the routine reverts to step SP204 to continue the operational event detection operation. If the cancel button 159 has been mouse-clicked on the waveform recording control window 150, the automatic performance/waveform recording processing routine is immediately brought to an end. If the automatic performance start button 152 has been mouse-clicked on the control window 150, the processing routine moves on to step SP208, where reproduction of the designated automatic performance file is initiated. Also, at step SP208, the automatic performance stop button 154 and waveform recording start button 156 are set in the active state while the other window elements are set in the inactive state.

At next step S210, detection is made of operational events of the window elements currently set in the active state on the waveform recording control window 150. Then, at step SP212, the routine branches in accordance with a result of the operational event detection. If no operational event has been detected, the routine reverts to step SP210 to continue the operational event detection operation. If the automatic performance stop button 154 has been mouse-clicked on the control window 150, the reproduction of the automatic performance file is terminated, and the automatic performance/waveform recording processing routine is immediately brought to an end. If the waveform recording start button 156 has been mouse-clicked on the control window 150 as determined at step SP212, the routine moves on to step SP214, where is initiated recording of waveform data obtained sequentially via the microphone 6, A/D converter 108 and recording circuit 110; namely, the waveform data are recorded sequentially onto the hard disk 112 via the D/A converter 118 and recording circuit 110. Also, at step SP214, the automatic performance stop button 154 and waveform recording stop button 158 are set in the active state while the other window elements are set in the inactive state.

Figure 23A:
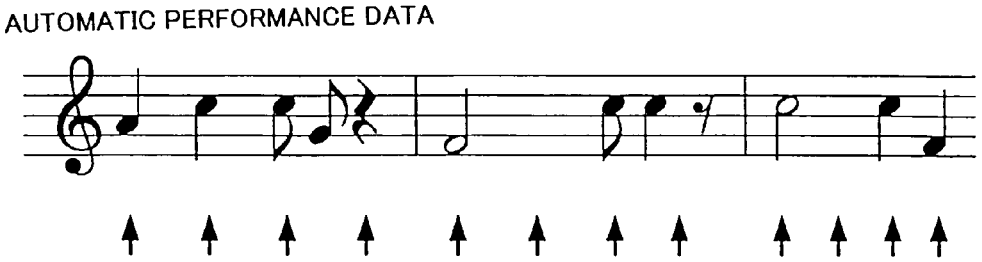
FIGS. 23A–23C are diagrams showing relationship in processing timing between automatic performance information and original waveform data in the second embodiment.
Figure 23B:
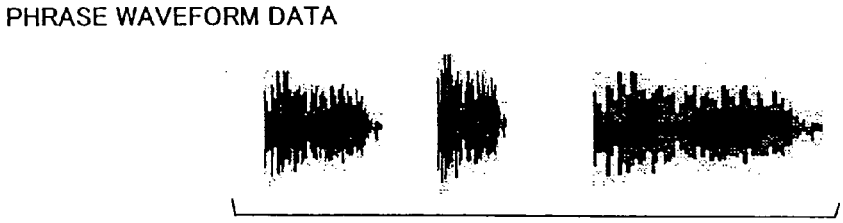
Figure 23C:
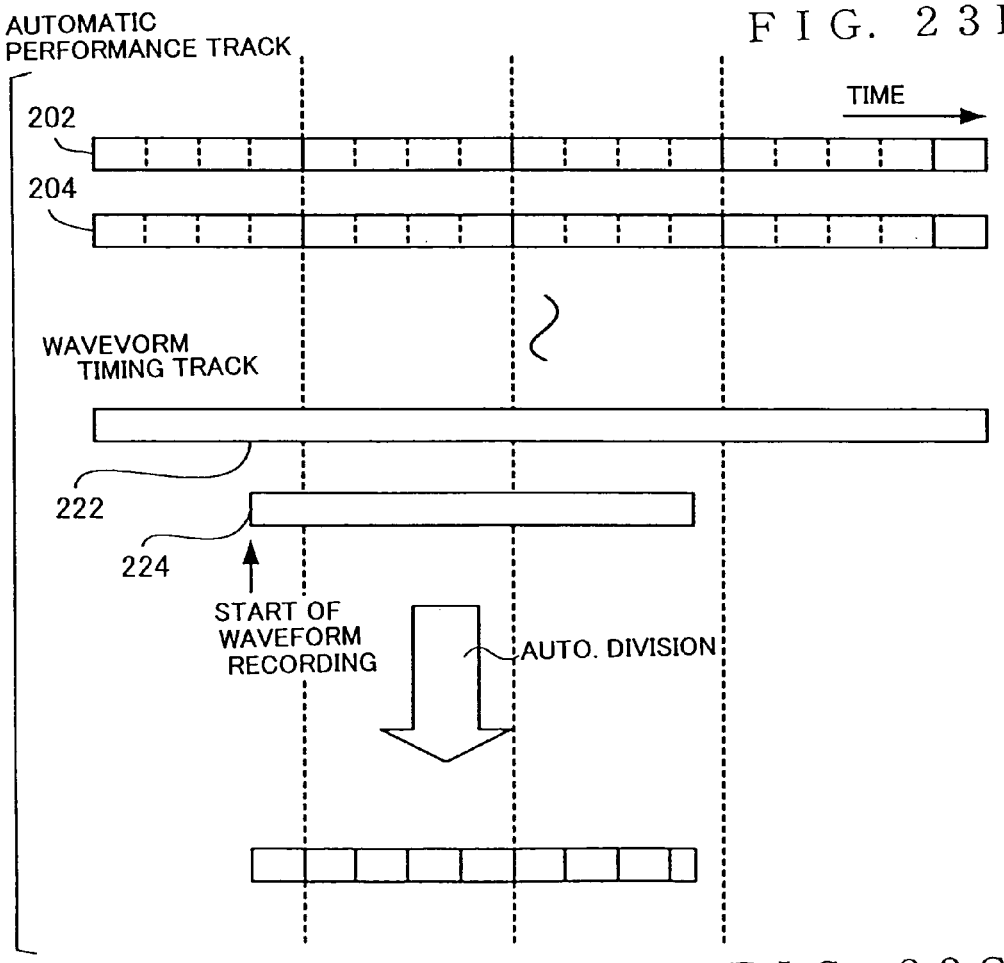

Here, details of the waveform recording process are explained with reference to FIGS. 23A–23C. FIG. 23A shows an example of a musical score based on automatic performance information, where marks "↑" each indicate beat timing. FIG. 23B shows an example of a phrase waveform (original waveform data) to be recorded that is displayed on the display device 8 in accordance with the timing indicated by the automatic performance information of FIG. 23A. FIG. 23C shows an example of relationship between the waveform data originally recorded on the hard disk 112 (original waveform data) and the automatic performance information.

In FIG. 23C, reference numerals 202 and 204 represent automatic performance tracks originally included in the automatic performance information (original sequence data). 224 represents a waveform data track where originally recorded original waveform data are stored, and 222 represents a waveform timing track where are recorded synchronization control data for synchronizing the automatic performance tracks and the waveform data track 224. In this case, the synchronization control data include data indicative of recording start timing and synchronization data to be described later. These waveform timing track 222 and waveform data track 224 are additional tracks added to the automatic performance information so as to be used for the recording process.

As clear from the above-described contents of the operations up to step SP214, the automatic performance has already been initiated when the waveform recording is initiated. Thus, as shown in FIGS. 23A and 23B, the start timing of the waveform recording is specified by the timing data on the automatic performance information (e.g., the number of timing clocks after the automatic performance start). The start timing of the waveform recording specified by the timing data is recorded onto the waveform timing track 222.

After that, the waveform recording process and automatic performance process are continued synchronously with each other using any one of the following synchronization schemes.

(1) The sampling cycles of the waveform data are synchronized with the tempo clocks of the automatic performance. In this case, there is no need to store the later-described synchronization data.

(2) The synchronization data are recorded onto a predetermined track of the automatic performance data (waveform timing track 222 in the illustrated example of FIGS. 23A–23C) while the waveform data are being sampled.

The (2) scheme may have the following variations depending on the nature of the synchronization data to be recorded.

(2-1) Every predetermined number of tempo clocks, a unique sample number of the waveform data at the current time point is recorded.

(2-2) Unique sample number of the waveform data at each beat timing (e.g., at each timing indicated by the mark "↑" in FIG. 23A) is recorded.

(2-3) Sequence position of every predetermined number (e.g., every 1,000 samples) of the waveform data is recorded.

It should be appreciated that the synchronization between the waveform recording process and the automatic performance process may be secured using any other suitable schemes than the above-mentioned.

Referring back to FIG. 21, detection is made, at step SP216, of operational events of the window elements currently set in the active state on the waveform recording control window 150. Then, at step SP218, the routine branches in accordance with a result of the operational event detection. If no operational event has been detected, the routine reverts to step SP216 to continue the operational event detection operation. If the automatic performance stop button 154 has been mouse-clicked on the control window 150, the routine goes to step SP222, where the reproduction of the automatic performance file is terminated. If the waveform recording stop button 158 has been mouse-clicked on the control window 150 as determined at step SP218, the routine goes to step SP220, where the reproduction of the waveform data recording is terminated.

Irrespective of which one of steps SP220 and SP222 has been taken, the routine goes next to step SP224, where a determination is made whether both of the automatic performance and waveform recording processes have now been terminated. If at least one of the automatic performance and waveform recording processes is in progress, a negative (NO) determination is made, so that the routine reverts to step SP216 to continue the operational event detection. Then, if both of the automatic performance and waveform recording processes have been terminated, an affirmative (YES) determination is made once the routine moves to step SP224, so that the routine is brought to an end.

From the above-described contents of the operations, it can be seen that the original recorded waveform data (original waveform data) are recorded here, in association with the timing data of the automatic performance information, in accordance with the synchronization control data. However, because a series of the original waveform data are recorded as it is, the above-described operations can not appropriately deal with increase or decrease in the automatic performance tempo. For appropriately dealing with increase or decrease in the automatic performance tempo, there arises a need for a process to divide the original waveform data into a plurality of original sections, as will be set forth below.

6.2. To-be-Reproduced-Waveform-Data Generation Processing:

Once predetermined operation is performed by the user after the acquisition of the original waveform data through the above-described waveform recording process, a to-be-reproduced-waveform-data generation processing routine, similar to that described above in relation to FIG. 4, is triggered in the waveform editing application program. However, in this second embodiment, the operation of step SP10 of FIG. 4 is omitted, so that the routine goes from step S8 directly to step SP12. At step SP12 in the second embodiment, default waveform data control points are automatically determined on the basis of the beat timing of the automatic performance information that was being reproduced during the recording. Because the beat timing is determined by the musical time of the automatic performance information, it is generated at time intervals of a quarter note or eighth note. Note that when the tempo is changed halfway through the automatic performance, the beat timing varies in accordance with the changed tempo. Regarding the waveform data, rise start positions, peak positions, etc. in tone volume envelopes are detected, and default waveform data control points are determined on the basis of relationship between the detected results and the beat timing. The thus-determined default waveform data control points are displayed on the display device 8 along with the waveform data in the same manner as shown in FIG. 2A. In this case, the operation for determining the default waveform data control points can be carried out in the same manner as described earlier in relation to FIG. 6, and the flow chart of FIG. 6 can also be applied here.

Description already made about the behavior of the first embodiment with reference to FIGS. 2–19 can also be applied to the second embodiment too, and thus the following paragraphs describe the second embodiment only in terms of matters that have not been discussed above in connection with the first embodiment and that are different from the counterparts of the first embodiment.

The second embodiment differs from the first embodiment in the manner of storing last data in the process for imparting envelopes to inserting sections 1*i*–12*i* (step SP 20 of FIG. 4). As previously noted, when waveform data for inserting sections 1*i*–12*i* have been determined, this practically means that waveform data for coupled sections 1*t*–12*t* have been determined. These waveform data of the coupled sections 1*t*–12*t* are written into the waveform data track 224 of the automatic performance information. Further, to the waveform timing track 222 are written start timing of the individual coupled sections 1*t*–12*t* (timing clock counts) and rising times Tt of the waveform data of the sections 1*t*–12*t*. Although not necessarily essential, writing the rising times Tt will allow the waveform data to be reproduced at even more preferable timing (see the above-described reproducing tempo setting/variation process). Further, in this second embodiment, the operation for removing the sense of "tardiness" or "heaviness" in the reproducing tempo setting/variation process) is performed by modifying waveform-data-generation-start triggering clock counts recorded in the waveform timing track 222.

"performance process" in the second embodiment slightly differs from the performance process in the first embodiment and thus will be described below with reference to FIG. 24.

In the second embodiment, the automatic performance information (synthesized sequence data) has the above-mentioned waveform timing track 222 and waveform data track 224 added thereto. The following paragraphs describe a manner in which the performance process is executed on the basis of such special data. Once initiation of an automatic performance is instructed, tempo clock are generated at intervals of "1/64" of a quarter note on the basis of a designated tempo. During the automatic performance, the routine shown in FIG. 24 is executed per tempo clock thus generated.

Figure 24:
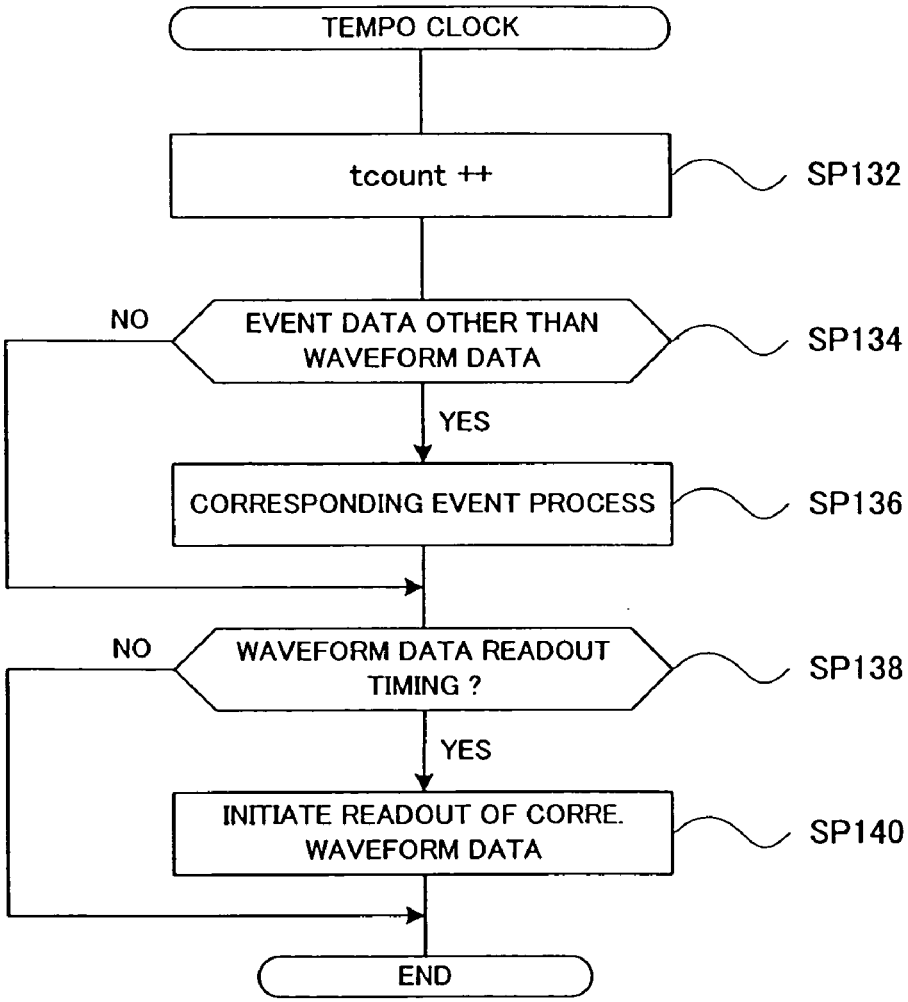
FIG. 24 is a flow chart of a performance process routine performed in the second embodiment.

At step SP132 of FIG. 24, a variable tcount is incremented by "1". Note that the variable tcount has been initialized to a value "0" at the beginning of the automatic performance and functions as a variable counting the number of tempo clocks from the beginning of the automatic performance to the current time point. Then, at step SP134, a determination is made, on the basis of the current value of the variable tcount, as to whether event timing other than that of waveform data has arrived or not. Namely, the automatic performance tracks 202 and 204 have event data, such as note-on and note-off event data, recorded therein in order of occurrence, and these event data each include timing data corresponding to a tempo clock in response to which the event should be caused to occur. Therefore, by referring to the timing data included in the event data at the head of each of the performance tracks, it is possible to ascertain whether event timing has arrived or not.

If answered in the affirmative at step SP134, the routine goes to step SP136 in order to perform an event operation corresponding to the event data. If the event data represents a note-on event, a new tone generating channel is assigned in the tone generator 122 in response to an instruction by the CPU 10, so that a tone signal is synthesized by the assigned tone generating channel. The thus-synthesized tone signal is sounded via the mixer 116, D/A converter 118 and sound system 28. If the event data represents a note-off event, a tone deadening (silencing) operation is performed by a designated tone generating channel.

In case the event timing of next event data has not yet been reached, a negative determination is made at step SP134, so that the routine goes to step SP138. At step SP138, it is determined whether predetermined timing has arrived for start reading out the waveform data of any one of the coupled sections. As previously noted, the default readout start timing for the waveform data of the coupled sections is previously recorded in the waveform timing track 222. However, the readout start timing referred to at step SP138 is timing modified on the basis of a rising time Tt, i.e. timing corresponding to "n(Ts+Tt)−Tt" discussed above.

With an affirmative answer at step SP138, the routine goes to step SP140, where readout of the corresponding waveform data is initiated. Here, the waveform data readout rate is controlled in accordance with a value of a pitch shift amount as will be described later. If the pitch shift amount is "0", the waveform data readout rate is set to the same rate as the data writing rate at which the waveform data were originally recorded (original data write rate). If the pitch shift amount is of a positive value, the waveform data readout rate is set to be higher than the original data write rate, while if the pitch shift amount is of a negative value, the waveform data readout rate is set to be lower than the original data write rate. As well known in the art, the pitch of the read-out waveform data becomes higher as the waveform data readout rate gets higher, but becomes lower as the waveform data readout rate gets lower.

Thus, even when some other waveform data were being read out till just before the current time point, readout of new waveform data can be initiated at step SP140 in such a manner as to replace the other waveform data. If answered in the negative at step SP138, the operation of step SP140 is omitted, so that the instant routine is brought to an end without replacing the currently read-out waveform data.

According to the process arranged in the above-described manner, waveform data readout of the leading or first coupled section 1*t* is initiated immediately when the value of the variable tcount arrives at waveform data readout timing of the coupled section 1*t*. Then, once the value of the variable tcount arrives at waveform data readout timing of the second coupled section 2*t*, the waveform data readout of the first coupled section 1*t* is terminated, and waveform data readout of the second coupled section 2*t* is initiated. To provide a smooth connection between the successive coupled sections 1*t* and 2*t*, the waveform data of a portion of the first coupled section 1*t*where the waveform data readout is to be terminated and the waveform data of a portion of the second coupled section 2*t* where the waveform data readout is to be initiated may be interconnected in a cross-fading fashion. The waveform data sequentially read out with the foregoing operation are sounded sequentially via the reproduction circuit 114, mixer 116, D/A converter 118 and sound system 28. In the same manner, waveform data readout of the following coupled sections 3*t*–12*t* is initiated sequentially in accordance with increment in the value of the variable tcount. Tone waveforms actually generated through the foregoing operations are similar to those described earlier in relation to FIG. 18 and hence explanation of the tone waveform is omitted to avoid unnecessary duplication.

7. Advantageous Results of Second Embodiment:

As described above, the second embodiment is arranged to record the synchronization data for the automatic performance information into the waveform timing track 222 as the original waveform data are recorded into the waveform data track 224. Thus, the second embodiment can secure synchronism between the original waveform data and to-be-reproduced waveform data generated on the basis of the original waveform data and the original automatic performance information. Further, in the instant embodiment, reproduction of each of the original sections can be initiated at the timing "n(Ts+Tt)−Tt" by modifying the waveform-data-generation-start triggering clock count in accordance with relationship between the original edge start time position Ts and rising time Tt and the reproducing tempo (tempo expansion/compression ratio n), and thus it is possible to secure appropriate consistency between the tempo expansion/compression ratio n and beat timing felt by the human auditory sense.

8. Modifications of Second Embodiment:

It should be appreciated that the present invention is not limited to the scope of the above-described embodiments and various modifications of the second embodiment are also possible as set forth below; note that the second embodiment may be modified in the same manner as described earlier in items (1)–(10) in relation to the first embodiment.

(11) Whereas the second embodiment has been described above as analyzing the envelopes of the entire waveform data, it may analyze portions of the waveform data near the reference positions, e.g., portions corresponding to the beat detecting windows.

(12) It should be understood that the process for determining dividing positions (waveform data control points) of the original waveform data is not limited to the one described above in relation to the second embodiment. For example, although the second embodiment has been described as determining the waveform data control points using the beat timing of the automatic performance information as the reference positions of the detecting windows, individual note-on timing (timing of notes in FIG. 23A) or note-off timing may be set as the reference positions of the detecting windows.

(13) Furthermore, whereas the second embodiment has been described above as first recording the original waveform data in the waveform data track 224 and then determining the waveform data control points, the waveform data control points may be determined during recording of the original waveform data, provided that the CPU 10 has sufficiently high processing capability.

(14) Moreover, in the described second embodiment, the resolution with which to determine the waveform data control points is designated after the recording of the original waveform data. Alternatively, the resolution may be designated prior to the recording of the original waveform data.

The present invention arranged in the above-described manner can readily synchronize the waveform data with the automatic performance information because it records the waveform data while recording the synchronization data indicating relationship between the automatic performance information and the waveform data.

Further, by the arrangement of determining envelope levels of the waveform data and then determining waveform data dividing positions on the basis of the synchronization data and envelope levels, the present invention can efficiently extract effective rise positions as the waveform data dividing positions. Also, by extracting the rise positions in correspondence with the presumed beat positions, the present invention can detect the rise positions in a stable manner while effectively preventing erroneous detection. Stated differently, points that are located near originally-expected dividing positions and also considered to be appropriate from a musical point of view can be set as the waveform data dividing positions. Thus, the present invention can reliably prevent erroneous detection of the waveform data dividing positions and waveform data division at musically inappropriate positions.

Furthermore, with the arrangement that presumed beat positions are determined on the basis of beat timing or note-on or note-off timing of the automatic performance information, the present invention can detect the waveform data diving points efficiently using information originally included in the automatic performance information.

Furthermore, with the arrangement that one of a plurality of rise positions belonging to a predetermined range is selected and extracted as a waveform data dividing position of the original waveform data, the present invention can efficiently eliminate any unnecessary rise positions.

The present invention relates to the subject matter of Japanese Patent Application Nos. 2001-008813, 2001-008814 and 2001-008815 filed Jan. 17, 2001, the disclosure of which is expressly incorporated herein by reference in its entirety.

The invention claimed is:

1. A waveform data processing method comprising:

a step of dividing original waveform data into a plurality of partial waveform data;

a step of creating a plurality of additional waveform data, each of which corresponds to one of the partial waveform data;

a step of coupling each of the additional waveform data to a tail of the corresponding partial waveform data to obtain a plurality of coupled waveform data, each of the additional waveform data in the coupled waveform data attenuating, with passage of time, from an initial value equal to an envelope level at an end of the corresponding one of the partial waveform data;

a step of storing, in a memory, each of the coupled waveform data;

a step of, when a reproducing tempo for reproduction of the waveform data is faster than a predetermined standard of the waveform data, using each of the partial waveform data in the coupled waveform data stored in said memory to reproduce a waveform of the reproducing tempo which doesn't contain the additional waveform data; and a step of, when the reproducing tempo for reproduction of the waveform data is slower than the predetermined standard of the waveform data, using each of the coupled waveform data stored in said memory to reproduce a waveform of the reproducing tempo which contains at least a part of the additional waveform data.

2. A waveform data processing method as claimed in claim 1, further comprises a step of detecting an attenuation rate of each of the partial waveform data corresponding to each of the additional waveform data, wherein each of the additional waveform data is imparted with attenuation characteristics based on the attenuation rate detected by said step of detecting.

3. A waveform data processing method comprising:

a step of dividing original waveform data into a plurality of sections;

a step of, in correspondence with the sections divided from the original waveform data by said step of dividing, generating and storing waveform data of additional sections to be added to individual ones of the divided sections;

a step of, when a reproducing tempo for reproduction of the waveform data is faster than a predetermined standard, using the original waveform data of the individual divided sections to reproduce a waveform without using the waveform data of the additional sections; and a step of, when the reproducing tempo is slower than the predetermined standard, reproducing a waveform by adding the waveform data of corresponding ones of the additional sections to the divided sections to follow the waveform data of the divided sections.

4. A waveform data processing method as claimed in claim 3 wherein the predetermined standard is an original tempo of the original waveform data.

5. A computer program comprising computer program code means for performing all the steps of claim 1 when said program is run on a computer.

6. A computer program comprising computer program code means for performing all the steps of claim 3 when said program is run on a computer.

7. A waveform data analysis and reproduction apparatus comprising:

an acquisition device that acquires original waveform data;

a divider that divides original waveform data, acquired by said acquisition device, into a plurality of partial waveform data;

a creator that creates a plurality of additional waveform data, each of which corresponds to one of the partial waveform data;

a coupler that couples each of the additional waveform data to a tail of the corresponding partial waveform data to obtain a plurality of coupled waveform data, each of the additional waveform data in the coupled waveform data attenuating, with passage of time, from an initial value equal to an envelope level at an end of the corresponding one of the partial waveform data; and a memory that stores, each of the coupled waveform data;

a reproduction device, wherein when a reproducing tempo for reproduction of the waveform data is faster than a predetermined standard of the waveform data, the reproduction device uses each of the partial waveform data in the coupled waveform data stored in said memory to reproduce a waveform of the reproducing tempo that does not contain the additional waveform data, and wherein when the reproducing tempo for reproduction of the waveform data is slower than the predetermined standard of the waveform data, the reproduction device uses each of the coupled waveform data stored in said memory to reproduce a waveform of the reproducing tempo which contains at least a part of the additional waveform data.

8. A waveform data analysis apparatus comprising:

a storage device that stores original waveform data; and a processor coupled with said storage device and adapted to:

divide original waveform data into a plurality of sections;

in correspondence with the divided sections, generate and store waveform data of additional sections to be added to individual ones of the divided sections;

when a reproducing tempo for reproduction of the waveform data is faster than a predetermined standard, use the original waveform data of the individual divided sections to reproduce a waveform without using the waveform data of the additional sections; and when the reproducing tempo is slower than the predetermined standard, reproduce a waveform by adding the waveform data of corresponding ones of the additional sections to the divided sections to follow the waveform data of the divided sections.

9. A waveform data analysis and reproduction apparatus comprising:

an acquisition device that acquires original waveform data;

a divider that divides original waveform data into a plurality of sections of a waveform;

a creator that, in correspondence with the divided sections, creates waveform data for each of a plurality of additional sections corresponding to each of the divided sections;

a coupler that couples each of the additional sections to a tail of the corresponding one of the divided sections to obtain a plurality of coupled sections of the waveform;

a memory that stores the coupled sections of the waveform; and a reproduction device, wherein when a reproducing tempo for reproduction of the waveform data is faster than a predetermined standard of the waveform, the reproduction device uses each of the divided sections in the coupled sections stored in said memory to reproduce a waveform of the reproducing tempo which doesn't contain the additional sections, and wherein when the reproducing tempo for reproduction of the waveform data is slower than the predetermined standard of the waveform, the reproduction device uses each of the coupled sections stored in said memory to reproduce a waveform of the reproducing tempo which contains at least a part of the additional sections.

* * * * *